US005893967A

United States Patent [19]

Knall et al.

[11] Patent Number: 5,893,967

[45] Date of Patent: Apr. 13, 1999

[54] IMPEDANCE-ASSISTED ELECTROCHEMICAL REMOVAL OF MATERIAL, PARTICULARLY EXCESS EMITTER MATERIAL IN ELECTRON-EMITTING DEVICE

[75] Inventors: N. Johan Knall, Sunnyvale; Christopher J. Spindt, Menlo Park; Gabriela S. Chakarova, San Jose, all of Calif.; Duane A. Haven, Umpqua, Oreg.; John M. Macaulay, Mountain View; Roger W. Barton, Palo Alto, both of Calif.; Maria S. Nikolova; Peter C. Searson, both of Baltimore, Md.

[73] Assignee: Candescent Technologies Corporation, San Jose, Calif.

[21] Appl. No.: 08/884,700

[22] Filed: Jun. 30, 1997

Related U.S. Application Data

[63] Continuation-in-part of application No. 08/610,729, Mar. 5, 1996, Pat. No. 5,766,466.

[51] Int. Cl.[6] ..... C25F 3/00

[52] U.S. Cl. ..... 205/640; 205/674; 205/685

[58] Field of Search ..... 205/640, 652, 205/666, 667, 674, 685

[56] References Cited

U.S. PATENT DOCUMENTS

| | | | |
|---|---|---|---|
| 2,334,699 | 11/1943 | Faust . | |
| 2,928,777 | 3/1960 | Smith | 204/140.5 |
| 3,174,920 | 3/1965 | Post . | |
| 3,407,125 | 10/1968 | Fehlner . | |
| 3,483,108 | 12/1969 | Schaefer . | |

(List continued on next page.)

FOREIGN PATENT DOCUMENTS

| | | |
|---|---|---|
| 0234989 A1 | 9/1987 | European Pat. Off. . |
| 0697710 A1 | 2/1996 | European Pat. Off. . |
| 0708473 A1 | 4/1996 | European Pat. Off. . |
| WO 95/07543 | 3/1995 | WIPO . |
| WO 96/06443 | 2/1996 | WIPO . |

OTHER PUBLICATIONS

Brodie et al, "Vacuum Microelectronics," *Advances In Electronics And Electron Physics*, vol. 83, 1992, pp. 1–106. (No Month).

Busta, "Vacuum Microelectronics–1992," *J. Micromech. Microeng.*, vol. 2, 1992, pp. 43–74 (No Month).

Cochran et al, "Low–Voltage Field Emission from Tungsten Fiber Arrays in a Stabilized Zirconia Matrix," *J. Mater. Res.*, May/Jun. 1987, pp. 322–328.

Datta et al, "Film Breakdown on Nickel under Transpassive Dissolution Conditions in Sodium Nitrate Solutions," *J. Electrochem. Soc.: Electrochemical Science and Technology*, Apr. 1977, vol. 124, No. 4, pp. 483–489.

Datta et al, "On the Influence of Electrolyte Concentration, pH and Temperature on Surface Brightening of Nickel under ECM Conditions," *J. Applied Electrochemistry*, 1977, pp. 247–252. No Month.

Datta et al, "On the Role of Mass Transport in High Rate Dissolution of Iron and Nickel in ECM Electrolytes–I. Chloride Solutions," *Electrochimica Acta*, 1980, vol. 25, pp. 1255–1262. No Month.

Datta et al, "Surface Brightening During High Rate Nickel Dissolution in Nitrate Electrolytes," *J. Electrochem. Soc.: Electrochemical Science and Technology*, Nov. 1975, pp. 1466–1472.

(List continued on next page.)

*Primary Examiner*—Donald R. Valentine

*Attorney, Agent, or Firm*—Skjerven, Morrill, MacPherson, Franklin & Friel LLP; Ronald J. Meetin

[57] ABSTRACT

An impedance-assisted electrochemical method is employed for selectively removing certain material from a structure without significantly electrochemically removing certain other material of the same chemical type as the removed material.

40 Claims, 9 Drawing Sheets

U.S. PATENT DOCUMENTS

| | | | |
|---|---|---|---|
| 3,665,241 | 5/1972 | Spindt et al. . | |
| 3,755,704 | 8/1973 | Spindt et al. . | |
| 3,998,678 | 12/1976 | Fukase et al. . | |
| 4,008,412 | 2/1977 | Yuito et al. . | |
| 4,208,257 | 6/1980 | Hom-ma et al. . | |
| 4,385,971 | 5/1983 | Swartz | 204/129.1 |
| 4,629,539 | 12/1986 | Imai | 204/129.65 |
| 4,952,272 | 8/1990 | Okino et al. . | |
| 5,007,873 | 4/1991 | Goronkin et al. . | |
| 5,053,673 | 10/1991 | Tomii et al. . | |
| 5,170,092 | 12/1992 | Tomii et al. . | |
| 5,185,057 | 2/1993 | Playdon . | |
| 5,188,977 | 2/1993 | Stengl et al. . | |
| 5,199,917 | 4/1993 | MacDonald et al. . | |
| 5,217,586 | 6/1993 | Datta et al. . | |
| 5,256,565 | 10/1993 | Bernhardt et al. . | |
| 5,277,638 | 1/1994 | Lee . | |
| 5,424,605 | 6/1995 | Lovoi . | |
| 5,458,520 | 10/1995 | DeMercurio et al. . | |
| 5,462,467 | 10/1995 | Macaulay et al. . | |
| 5,477,105 | 12/1995 | Curtin et al. . | |
| 5,559,389 | 9/1996 | Spindt et al. . | |
| 5,564,959 | 10/1996 | Spindt et al. . | |
| 5,589,731 | 12/1996 | Fahlen et al. . | |
| 5,641,391 | 6/1997 | Hunter et al. | 205/640 |
| 5,766,446 | 6/1998 | Spindt et al. | 205/640 |

OTHER PUBLICATIONS

Huang et al, "200–nm Gated Field Emitters", *IEEE Electron Device Letters,* Mar. 1993, pp. 121–122.

LaBoda et al, "ECM of Nickel in $NaClO_3$ Solution," *J. Electrochem. Soc.: Electrochemical Science and Technology,* vol. 120, No. 5, May 1973, pp. 643–646.

Landolt et al, "High Rate Anodic Dissolution of Copper," *J. Electrochem. Soc.: Electrochemical Science,* vol. 116, No. 10, Oct. 1969, pp. 1384–1390.

Penner et al, "Preparation and Electrochemical Characterization of Ultramicroelectrode Ensembles," *Anal. Chem.,* Nov. 1, 1987, pp. 2625–2630.

Spindt, "A Thin–Film Field–Emission Cathode," *J. App. Phys.* vol. 39, Jun. 1968, pp. 3504–3505.

Spindt et al, "Physical Properties of Thin–Film Field Emission Cathodes with Molybdenum Cones," *J. Appl. Phys,* Dec. 1976, pp. 5248–5263. No Month.

Spindt et al, "Research in Micron–Size Field–Emission Tubes," *IEEE Conf. Record, 1966 Eighth Conf. on Tube Techniques,* 20–22 Sep. 1966, pp. 143–147.

Vaudaine et al, "'Microtips' Fluorescent Display," *Technical Digest,* 1991 International Electron Devices Meeting, Dec. 8–11, 1991, pp. 8.1.1–8.1.4.

IMPEDANCE-ASSISTED ELECTROCHEMICAL REMOVAL OF MATERIAL, PARTICULARLY EXCESS EMITTER MATERIAL IN ELECTRON-EMITTING DEVICE

CROSS-REFERENCE TO RELATED APPLICATION

This is continuation-in-part of Spindt et al. U.S. patent application Ser. No. 08/610,729, filed Mar. 5, 1996, now U.S. Pat. No. 5,766,466, the contents of which are incorporated by reference to the extent not repeated herein.

FIELD OF USE

This invention relates to removing undesired portions of material from partially finished structures without removing desired portions of the same type of material, especially when the structures are electron-emitting devices, commonly referred to as cathodes, suitable for products such as cathode-ray tube ("CRT") displays of the flat-panel type.

BACKGROUND ART

A field-emission cathode (or field emitter) contains a group of electron-emissive elements that emit electrons upon being subjected to an electric field of sufficient strength. The electron-emissive elements are typically situated over a patterned layer of emitter electrodes. In a gated field emitter, a patterned gate layer typically overlies the patterned emitter layer at the locations of the electron-emissive elements. Each electron-emissive element is exposed through an opening in the gate layer. When a suitable voltage is applied between a selected portion of the gate layer and a selected portion of the emitter layer, the gate layer extracts electrons from the electron-emissive elements at the intersection of the two selected portions.

The electron-emissive elements are often shaped as cones. Referring to the drawings, FIGS. 1*a*–1*d* illustrate a conventional technique as, for example, disclosed in Spindt et al. U.S. Pat. No. 3,755,704, for creating conical electron-emissive elements in a gated field emitter for a flat-panel CRT display. At the stage shown in FIG. 1*a*, the partially finished field emitter consists of an electrically insulating substrate 20, an emitter electrode layer 22, an intermediate dielectric layer 24, and a gate layer 26. Gate openings 28 extend through gate layer 26. Corresponding, somewhat wider dielectric openings 30 extend through dielectric layer 24.

Using a grazing-angle deposition procedure, a lift-off layer 32 is formed on top of gate layer 26 as depicted in FIG. 1*b*. Emitter material is deposited on top of the structure and into dielectric openings 30 in such a way that the apertures through which the emitter material enters openings 30 progressively close. In U.S. Pat. No. 3,755,704, a closure material is simultaneously deposited at a grazing angle to help close the deposition apertures. Generally conical electron-emissive elements 34A are thereby formed in composite openings 28/30 over emitter layer 22. See FIG. 1*c*. A continuous layer 34B of the emitter/closure material forms on top of gate layer 26. Lift-off layer 32 is subsequently removed to lift off excess emitter/closure-material layer 34B. FIG. 1*d* shows the resultant structure.

Utilization of lift-off layer 32 to remove excess emitter/closure-material layer 34B is disadvantageous for various reasons. Portions of the lift-off material invariably accumulate along the side edges of gate layer 26. This reduces the size of the openings through which the emitter material is initially deposited and makes it difficult to scale down electron-emissive elements 34A. The grazing-angle deposition of lift-off layer 32 becomes increasingly difficult as the lateral area of the field emitter increases and thus presents an impediment to scaling up the field-emitter area.

The lift-off material deposition must be performed carefully to assure that no lift-off material accumulates on emitter layer 22 and causes cones 34A to be lifted off during the lift-off of excess layer 34B. Since layer 34B is removed as an artifact of removing lift-off layer 32, particles of the removed emitter material can contaminate the field emitter. Furthermore, deposition of the lift-off material takes fabrication time and therefore money.

Wilshaw, PCT Patent Publication WO 96/06443, discloses a process for manufacturing a gated field emitter in which each electron-emissive element consists of a molybdenum cone situated on a cylinder. The electron-emissive elements are formed over a bottom metal layer. Using an aqueous electrolytic solution, Wilshaw applies a potential of 2–4 volts to a niobium gate layer in order to electrochemically remove a layer of excess molybdenum that accumulated over the gate layer during the deposition of molybdenum through openings in the gate layer to form the conical portions of the electron-emissive elements.

Just before electrochemically removing the excess molybdenum, Wilshaw removes the bottom metal layer. Consequently, Wilshaw's electron-emissive elements are electrically isolated from one another during the electrochemical removal of the excess emitter material. Inasmuch as some electron-emissive elements may be electrically shorted to the excess molybdenum during the electrochemical removal step, Wilshaw needs this isolation to protect the unshorted electron-emissive elements since they could otherwise be electrically shorted through the back metal layer and the shorted elements to the excess molybdenum and thus could be electrochemically attacked in removing the excess molybdenum. Later, Wilshaw performs an operation on the back surface to nullify the presence of shorted electron-emissive elements. Finally, Wilshaw forms a resistive layer over the bottoms of the electron-emissive elements, and a layer of emitter electrodes over the resistive layer.

Wilshaw's electrochemical removal technique avoids the necessity to use to use a lift-off layer for removing the layer of excess emitter material. However, removing the back metal layer before electrochemically removing the excess molybdenum and then creating emitter electrodes after completing the electrochemical removal is time-consuming and requires several complex processing steps. Performing the additional electrical-short nullification operation further increases the fabrication time and complexity. In fabricating a gated field emitter having electron-emissive elements at least partially shaped as cones, it is desirable to have a technique for removing a layer that contains excess emitter material without incurring the fabrication inefficiency of Wilshaw or the fabrication difficulty involved in utilizing a lift-off layer.

GENERAL DISCLOSURE OF THE INVENTION

The present invention furnishes such a removal technique. In the invention, an impedance-assisted electrochemical procedure is employed for selectively removing certain material from a structure without significantly electrochemically attacking, and thus without significantly removing, certain other material of the same chemical type as the removed material.

The impedance assistance is implemented with an impedance component that typically constitutes a permanent part of the structure and, in any event, is present in the structure during the electrochemical removal operation. The impedance component has characteristics designed to overcome electrical short problems which occur when one or more portions of the material intended to remain in the structure become electrically coupled to the material intended to be removed. Due to the presence of the impedance component, each such electrical short is normally repaired (i.e., eliminated) automatically during the electrochemical removal without impairing the selectivity of the removal.

No lift-off layer need be utilized in electrochemically removing material according to the invention. When the electrochemical technique of the invention is employed to remove excess emitter material that accumulates over a control electrode of an electron emitter during the deposition of emitter material through openings in the control electrode to at least partially form electron-emissive elements, an emitter electrode situated below the electron-emissive elements can remain in place during the electrochemical removal. Unlike Wilshaw, there is no need to remove a bottom electrically conductive layer before performing the electrochemical removal in order to have the electron-emissive elements electrically isolated during the removal operation and then basically to form a replacement emitter electrode after completing the removal.

Nor, as in Wilshaw, is there any necessity to perform a separate, potentially complex operation to repair electrically shorted electron-emissive elements. The number of processing steps is reduced in the invention, thereby saving fabrication time and money.

The invention alleviates the problems that using a lift-off layer creates in scaling down electron-emissive elements and in scaling up the lateral area of the electron emitter. The possibility of unintentionally lifting off electron-emissive elements due to the use of a lift-off layer is avoided. Also, the invention avoids the emitter-material particulate contamination problem that can occur with use of a lift-off layer. The electrochemical removal technique of the invention thereby enables fabrication of the electron-emissive elements to be completed in an efficient, economical manner.

In the present electrochemical removal procedure, the first step is to provide an initial structure containing a first electrically non-insulating region which consists at least partially of first material. As discussed below, "electrically non-insulating" means electrically conductive or electrically resistive. The first non-insulating region can, for example, be a layer of excess emitter material that accumulates during deposition of emitter material to form electron-emissive elements.

The structure includes an impedance component (consisting of one or more impedance elements) electrically coupled to multiple electrically non-insulating members, such as electron-emissive elements. Each non-insulating member, like the non-insulating region, consists at least partially of the first material. An electrode, such as an emitter electrode, is typically electrically coupled through the impedance component to the non-insulating members. Although not intended, a small fraction of the non-insulating members may be shorted to the non-insulating region at this point and/or may become shorted to the non-insulating region during the electrochemical removal operation of the invention.

With the structure so arranged, at least part of the first material of the non-insulating region is electrochemically removed by applying a selected potential to the non-insulating region. The removal step normally entails subjecting the initial structure to an electrolytic solution. During the removal step, the impedance component is of sufficiently high impedance that the first material of each non-insulating member not shorted to the non-insulating region is not significantly attacked.

In particular, choosing the impedance component to be of the indicated sufficiently high impedance enables the unshorted non-insulating members to be effectively electrically isolated from any non-insulating member shorted to the non-insulating region. The selected potential, i.e., the potential applied to the non-insulating region for electrochemically removing the first material of the non-insulating region, is thus not transmitted to the unshorted non-insulating members. Hence, the unshorted non-insulating members are not significantly electrochemically attacked as a consequence of applying the selected potential to the non-insulating region.

Importantly, the first material of any shorted non-insulating member is substantially attacked during the electrochemical removal procedure. The attack terminates when enough of the first material has been removed to eliminate the short. Consequently, a short between the non-insulating region and any non-insulating member is automatically repaired in the invention without the necessity of removing the impedance component or the underlying electrode. Depending on how much of the first material of the non-insulating member remains, the now-repaired noninsulating member can often perform its intended function.

When the present electrochemical removal technique is employed in fabricating an electron emitter, a structure is typically first provided in which a control electrode overlies an electrically insulating layer situated over an impedance component. Electron-emissive elements, each consisting at least partially of electrically non-insulating emitter material, are situated in openings extending through the control electrode and the insulating layer. Each electron-emissive element is electrically coupled to the impedance component. An emitter electrode normally underlies the impedance component.

An excess layer consisting at least partially of the emitter material overlies the control electrode. The excess emitter-material layer is typically created as a by-product of depositing the emitter material into the openings to form the electron-emissive elements. With the impedance of the impedance component being sufficiently high, a suitable potential is applied to the excess emitter-material layer to electrochemically remove at least part, typically all, of it according to the invention without significantly attacking the emitter material of each electron-emissive element not shorted to the excess layer.

The electrochemical removal operation is conducted in an efficient, uncomplicated manner. Any short of an electron-emissive element to the control electrode or excess layer is automatically repaired in the invention. There is no need to remove the impedance component or emitter electrode before performing the electrochemical removal. Nor is there any need for a lift-off layer. Consequently, the invention provides a significant advance over the prior art.

BRIEF DESCRIPTION OF THE DRAWINGS

Like reference symbols are employed in the drawings and in the description of the preferred embodiments to represent the same, or very similar, item or items.

DESCRIPTION OF THE PREFERRED EMBODIMENTS

The present invention utilizes an impedance-assisted electrochemical technique to remove excess emitter material in creating electron-emissive elements for a gated field-emission cathode. Each such field emitter is suitable for exciting phosphor regions on a faceplate in a cathode-ray tube of a flat-panel display such as a flat-panel television or a flat-panel video monitor for a personal computer, a lap-top computer, or a workstation.

In the following description, the term "electrically insulating" (or "dielectric") generally applies to materials having a resistivity greater than $10^{10}$ ohm-cm. The term "electrically non-insulating" thus refers to materials having a resistivity below $10^{10}$ ohm-cm. Electrically non-insulating materials are divided into (a) electrically conductive materials for which the resistivity is less than 1 ohm-cm and (b) electrically resistive materials for which the resistivity is in the range of 1 ohm-cm to $10^{10}$ ohm-cm. These categories are determined at an electric field of no more than 1 volt/μm.

Examples of electrically conductive materials (or electrical conductors) are metals, metal-semiconductor compounds (such as metal silicides), and metal-semiconductor eutectics. Electrically conductive materials also include semiconductors doped (n-type or p-type) to a moderate or high level. Electrically resistive materials include intrinsic and lightly doped (n-type or p-type) semiconductors. Further examples of electrically resistive materials are (a) metal-insulator composites, such as cermet (ceramic with embedded metal particles), (b) forms of carbon such as graphite, amorphous carbon, and modified (e.g., doped or laser-modified) diamond, (c) and certain silicon-carbon compounds such as silicon-carbon-nitrogen.

The values of potentials that arise in performing the electrochemical removal technique of the invention are, for convenience, defined with respect to the standard hydrogen electrode scale of the International Union of Pure and Applied Chemists. This standard is termed a Normal Hydrogen Electrode herein.

Figure 1A:
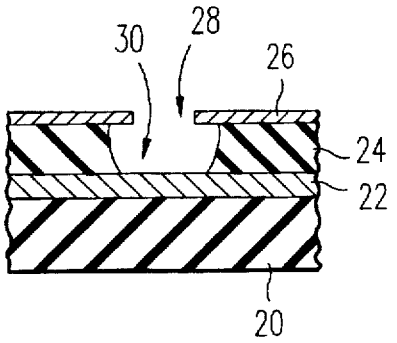
FIG. 1a PRIOR ART
FIGS. 1*a*–1*d* are cross-sectional structural views representing steps in a prior art process for creating electron-emissive elements in an electron emitter.
Figure 1B:
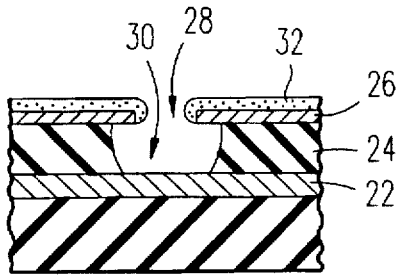
FIG. 1b PRIOR ART
Figure 1C:
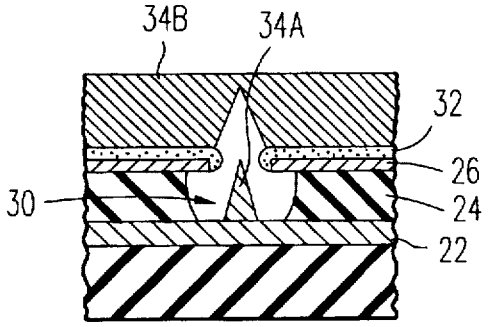
FIG. 1c PRIOR ART
Figure 1D:
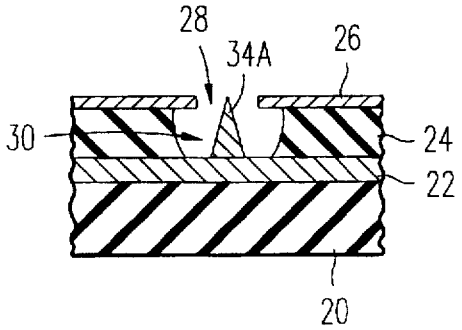
FIG. 1d PRIOR ART
Figure 2A:
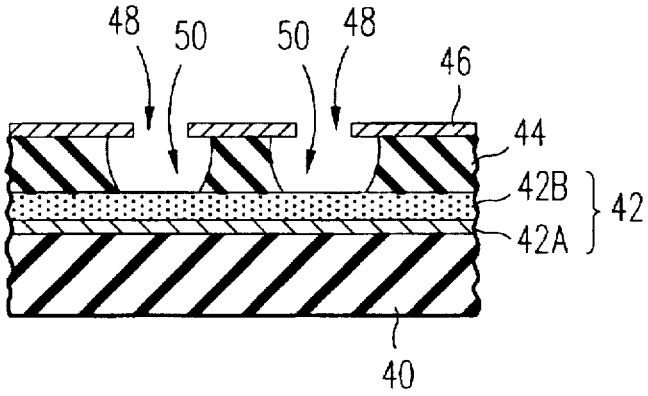
FIGS. 2*a*–2*c* are cross-sectional views representing steps in a process sequence that follows the invention's electrochemical teachings for creating conical electron-emissive elements in a gated field emitter.
Figure 2B:
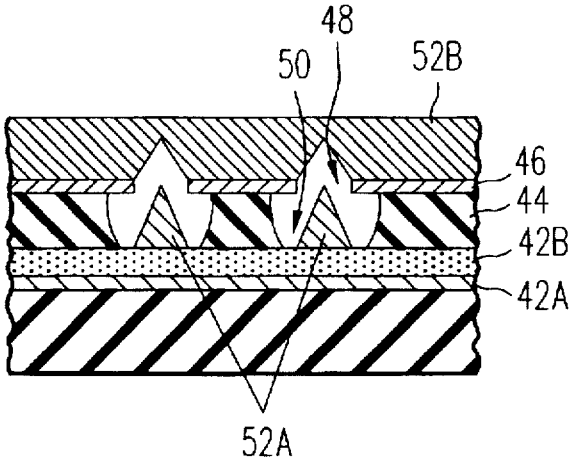
Figure 2C:
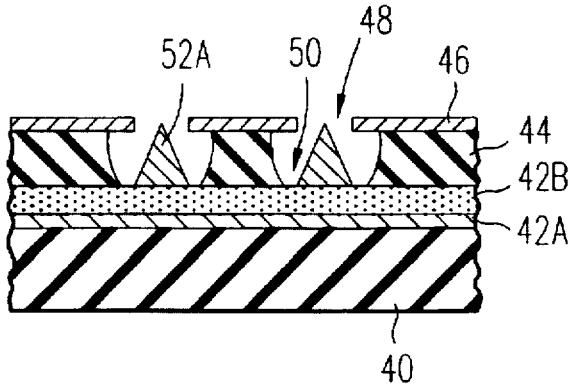

FIGS. 2*a*–2*c* (collectively "FIG. 2") illustrate how an impedance-assisted electrochemical technique is utilized in accordance with the invention to remove excess emitter material during the creation of electron-emissive elements for a gated field emitter. The starting point in the procedure of FIG. 2 is an electrically insulating substrate 40 typically formed with ceramic or glass. See FIG. 2*a*. Substrate 40, which provides support for the field emitter, is configured as a plate. For example, substrate 40 typically consists of a plate of Schott D263 glass having a thickness of approximately 1 mm. In a flat-panel CRT display, substrate 40 constitutes at least part of the backplate.

An emitter region 42 overlies substrate 40. Emitter region 42 consists of (a) a lower electrically conductive layer 42A patterned into emitter electrodes and (b) an upper emitter impedance component 42B. Emitter-electrode layer 42A is situated on top of substrate 40. The emitter electrodes of layer 42A extend generally parallel to one another in the direction of the rows of picture elements (pixels) in the CRT flat-panel display and thus constitute row electrodes. Layer 42A typically consists of a metal such as nickel or aluminum. The thickness of layer 42A is 100–500 nm, typically 200 nm.

Emitter impedance component 42B lies on top of emitter-electrode layer 42A. At the minimum, impedance component 42B needs to underlie each electron-emissive element. Component 42B need not be present at locations where there are no overlying electron-emissive elements.

Impedance component 42B can be constituted and configured in various ways. For example, impedance component 42B typically consists of one or more blanket layers of electrically resistive material. Component 42B can also be formed with one or more patterned layers of electrically resistive material. When component 42B is formed with electrically resistive material, emitter region 42 is an electrically non-insulating region. Other examples of the constitution and configuration of impedance component 42B are given below. The thickness of impedance component 42B depends on the value of its impedance and how component 42B is implemented to achieve the desired impedance value.

An electrically insulating layer 44, which serves as the interelectrode dielectric, is provided on top of the preceding. The thickness of insulating layer 44 is normally in the range of 0.05–3 μm. More specifically, layer 44 has a thickness of 100 nm–500 nm, typically 150 nm. Insulating layer 44 typically consists of silicon oxide or silicon nitride. Although not shown in FIG. 2*a*, parts of insulating layer 44 may contact substrate 40 depending on the configuration of impedance component 42B.

A patterned electrically non-insulating gate layer 46 consisting of selected gate material is situated on interelectrode dielectric layer 44. Gate layer 46 normally has a thickness in the range of 30–500 nm. More particularly the gate thickness is 30–100 nm, typically 50 nm. The gate material is normally metal, preferably chromium or/and nickel. Alternative candidates for the gate material include molybdenum, platinum, niobium, tantalum, titanium, tungsten, and titanium-tungsten.

Gate layer 46 may be patterned in various ways. For example, gate layer 46 can be configured as multiple generally parallel control electrodes for controlling the emission of electrons from the electron-emissive elements. Layer 46 typically forms part of a group of control electrodes having main control portions (not shown here) which contact portions of layer 46 and which extend generally parallel to one another. In either case, the control electrodes constitute column electrodes that extend perpendicular to the row electrodes of emitter layer 42A and thus extend along the columns of pixels.

A multiplicity of generally circular openings 48 extend through gate layer 46. Although the diameters of gate openings 48 depend on how openings 48 are created, the gate opening diameter is normally in the range of 0.05–2 μm. More specifically, the gate opening diameter is 80–400 nm, typically 150 nm.

A multiplicity of generally circular dielectric openings (or dielectric open spaces) 50 extend through insulating layer 44 down to impedance component 42B of emitter region 42. Each dielectric opening 50 is vertically aligned to a corresponding one of gate openings 48 to form a composite opening 48/50 that exposes part of impedance component 42B. Each dielectric open space 50 is somewhat wider than corresponding gate opening 48. Consequently, insulating layer 44 undercuts gate layer 46 along composite openings 48/50.

Various techniques can be employed to form composite openings 48/50 in layers 44 and 46. For example, openings 48/50 can be created by etching gate layer 46 through apertures in a mask, typically photoresist, to form gate openings 48 and then etching insulating layer 44 through openings 48 to create dielectric open spaces 50. Composite openings 48/50 can also be created by using etched charged-particle tracks as described in Macaulay et al, PCT Patent Publication WO 95/07543.

A micro-machining or selective etching technique of the type described in U.S. Pat. No. 3,755,704, cited above, can be utilized to form composite openings 48/50. Subject to different nomenclature and different materials, openings 48/50 can be formed according to the sphere-based procedure described in Spindt et al, "Research in Micron-Size Field-Emission Tubes," *IEEE Conf. Rec.* 1966 *Eighth Conf. on Tube Techniques*, Sep. 20, 1966, pages 143–147.

Electrically non-insulating emitter cone material is evaporatively deposited on top of the structure in a direction generally perpendicular to the upper surface of insulating layer 44 (or gate layer 46). The emitter cone material accumulates on gate layer 46 and passes through gate openings 48 to accumulate on impedance component 42B in dielectric open spaces 50. Due to the accumulation of the cone material on gate layer 46, the openings through which the cone material enters open spaces 50 progressively close. The deposition is performed until these openings fully close. As a result, the cone material accumulates in dielectric open spaces 50 to form corresponding conical electron-emissive elements 52A as shown in FIG. **2*b*. A continuous (blanket) layer 52B of the cone material is simultaneously formed on gate layer 46**.

The emitter cone material is normally metal, preferably molybdenum when gate layer 46 consists of chromium or/and nickel. Alternative candidates for the cone material include nickel, chromium, platinum, niobium, tantalum, titanium, tungsten, titanium-tungsten, and titanium carbide subject to the cone material differing from the gate material.

Using a suitable photoresist mask (not shown), one or more portions of excess emitter-material layer 52B along the lateral periphery of the partially finished field emitter are removed. Consequently, parts of gate layer 46 and/or (when present) parts of the main control portions that contact gate layer 46 are exposed along the lateral periphery of the field emitter. Selected internal portions of gate layer 46 and/or (when present) the main control portions are also typically exposed during the masked etch.

Figure 3A:
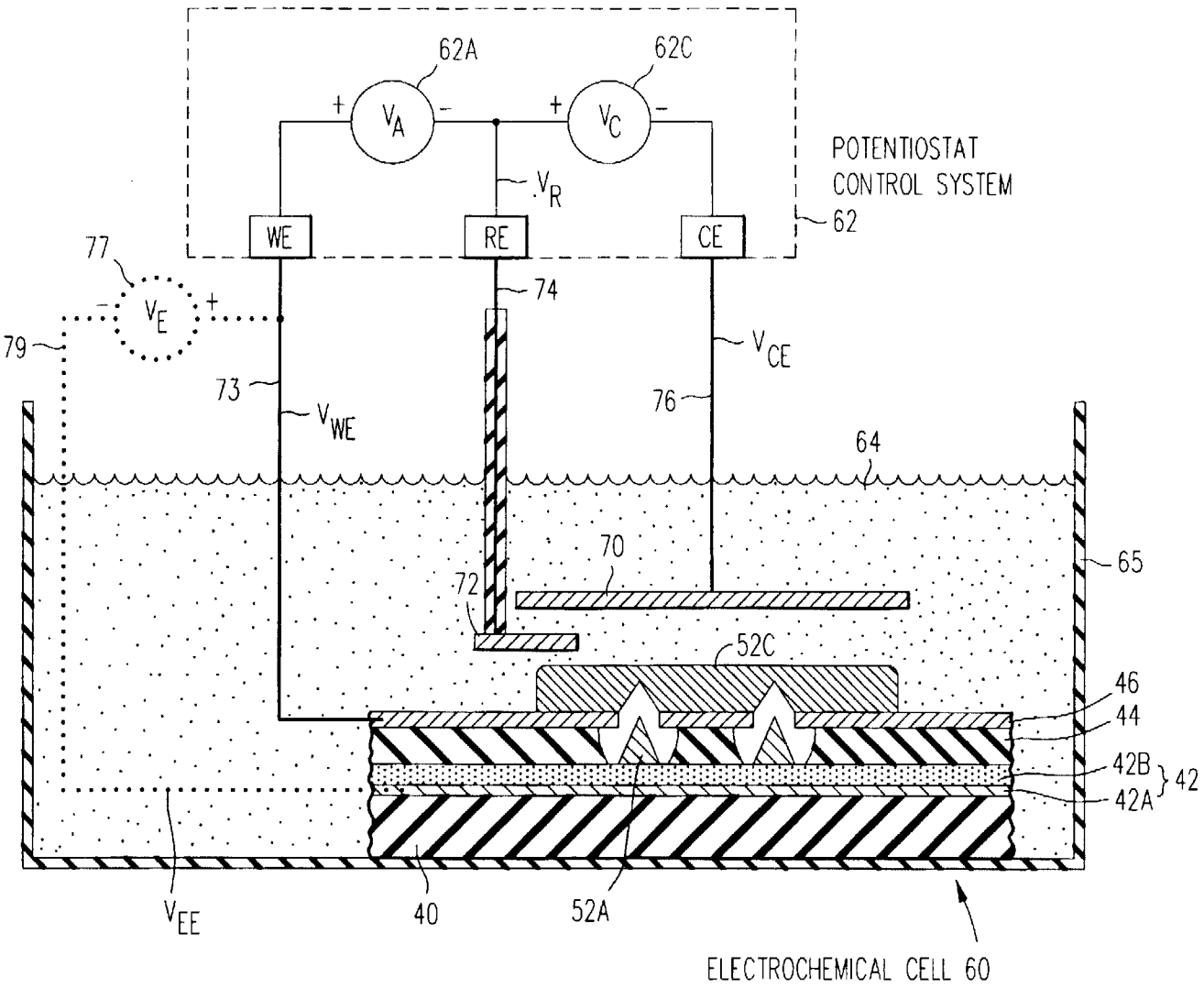
FIGS. 3*a* and 3*b* are cross-sectional schematic views of two implementations of a potentiostatic electrochemical system utilized in the procedure of FIGS. 2*a*–2*c*.

An electrochemical removal operation is now performed on the so-etched structure of FIG. **2*b* utilizing a potentiostatic electrochemical system of the type schematically shown in FIG. 3*a*. Item 52C in FIG. 3*a* is the portion of excess emitter-material layer 52B remaining after the masked etch described in the preceding paragraph. Excess emitter-material layer 52C** is removed during the electrochemical operation.

A small fraction of conical electron-emissive elements 52A are electrically shorted to gate layer 46 prior to electrochemically removing excess layer 52C and/or become electrically shorted to gate layer 46 during the electrochemical removal operation. Since excess layer 52C contacts gate layer 46, all of these electron-emissive cones 52C are shorted to excess layer 52C and, as discussed further below, are normally attacked significantly during the removal of layer 52C. The remaining cones 52A—i.e., cones 52A not shorted to layer 52C—are not significantly attacked as layer 52C is being removed. Likewise, the electrochemical removal operation is conducted without substantially attacking patterned gate layer 46 and (when present) the main control portions of the control electrodes.

The electrochemical removal system is formed with an electrochemical cell 60 and a control system 62 in the form of a potentiostat that regulates the cell operation. Electrochemical cell 60 consists of an electrolytic solution 64, a cell wall 65, a counter electrode 70, and a reference electrode 72. The partially finished field emitter is immersed in electrolytic solution 64.

Counter electrode 70, typically platinized titanium or platinum, is immersed in electrolytic solution 64 and extends parallel to excess emitter-material layer 52C. Reference electrode 72, typically silver/silver chloride or mercury/mercurous chloride (Calomel), is situated in solution 64, preferably close to layer 52C.

Control system 62 has a working-electrode terminal WE, a reference-electrode terminal RE, and a counter-electrode terminal CE. Cell 60 is electrically connected to control system 62 by a working-electrode conductor 73, an electrically insulated reference-electrode conductor 74, and a counter-electrode conductor 76. Conductors 73, 74, and 76 all typically consist of plantinum wire or electrically insulated copper wire.

Working-electrode conductor 73 is electrically coupled to the control electrodes. This coupling is made directly to gate layer 46 as shown in FIG. **3*a* when layer 46 is patterned into control electrodes, or by way of (when present) the main control portions of the control electrodes. Since gate layer 46 is in contact with excess emitter-material layer 52C, the combination of layers 46 and 52C and the main control portions forms a working anode electrode for cell 60. Reference-electrode conductor 74 is electrically connected to reference electrode 72. Counter-electrode conductor 76 is electrically connected to counter electrode 70**.

Electrochemical cell 60 is operated in a potentiostatic (constant-potential) mode. Reference electrode 72 provides a highly reproducible fixed reference potential $V_R$. When electrode 72 is a silver/silver chloride reference electrode, reference potential $V_R$ is approximately 0.2 volt relative to a Normal Hydrogen Electrode at room temperature.

Control system 62 operates as a potentiostat to place working-electrode conductor 73 at a largely constant working-electrode driving potential $V_{WE}$ that normally exceeds reference potential $V_R$ on reference-electrode conductor 74 by a largely fixed anodic potential $V_A$. Under some operating conditions, anodic potential can be negative so that working-electrode driving potential $V_{WE}$ is less than $V_R$. In FIG. 3*a*, potential $V_A$ is schematically depicted as being provided by a voltage source 62A in potentiostatic control system 62. Driving potential $V_{WE}$ equals $V_A+V_R$ referenced to a Normal Hydrogen Electrode. Potential VWE is applied through conductor 73 and through the control electrodes (constituted by gate layer 46 or the combination of layer 46 and the adjoining main control portions) to excess layer 52C for dissolving the excess emitter material during the electrochemical removal procedure.

Control system 62 places counter-electrode conductor 76 at a largely constant counter-electrode potential $V_{CE}$. Reference potential $V_R$ exceeds counter-electrode potential $V_{CE}$ by a largely fixed counter potential $V_C$. In FIG. 3*a*, counter potential $V_C$ is schematically depicted as being supplied by a voltage source 62C in control system 62. Counter-electrode potential $V_C$ equals $V_R-V_C$.

The potential on emitter-electrode layer 42A can be handled in any of three ways, all of which result in (a) excess emitter-material layer 52C being electrochemically removed and (b) any shorted cone 52A typically being attacked sufficiently to repair the short, but without unshorted cones 52A being attacked significantly.

Firstly, the potential on emitter-electrode layer 42A can be left unregulated—i.e., no special action is taken to control the potential of layer 42A. Depending on the materials electrically coupled to layer 42A, including any shorted cones 52A, the potential on layer 42A may reach a value close to driving potential $V_{WE}$ on the working electrode formed with gate layer 46, excess layer 52C, and (when present) the separate main control portions of the control electrodes. In order to prevent unshorted cones 52A from being significantly attacked during the electrochemical removal of excess layer 52C, the minimum value of the impedance provided by impedance component 42B for handling the potential on layer 42A is the highest of that occurring in the three techniques.

Secondly, emitter-electrode layer 42A can be electrolytically self-biased to a negative potential relative to potential $V_{WE}$. The emitter-electrode self-biasing technique is implemented by appropriately choosing the electrically non-insulating materials electrically coupled to electron-emissive cones 52A and in contact with electrolytic solution 64. These non-insulating materials consist of the materials which form impedance component 42B, emitter-electrode layer 42A, and further metal regions (not shown) that provide external electrical connections to layer 42A. Since cones 52A are electrically coupled through impedance component 42B to emitter-electrode layer 42A, cones 52A are thus at a negative potential relative to the working electrode.

Thirdly, emitter-electrode layer 42A can be actively maintained at a largely constant emitter-electrode potential $V_{EE}$ below working-electrode potential $V_{WE}$. For this purpose, a largely fixed emitter potential $V_E$ is provided by a voltage source 77 connected between working-electrode conductor 73 and a further electrical conductor 79 connected to emitter-electrode layer 42A. Inasmuch as voltage source 77 and further conductor 79 are optional, they are indicated in dotted line in FIG. 3*a*. Emitter-electrode potential $V_{EE}$ equals $V_{WE}-V_E$. Since working-electrode potential $V_{WE}$ equals $V_A+V_R$, potential $V_{EE}$ also equals $V_A+V_R-V_E$.

In the absence of any significant current flow through emitter-electrode layer 42A in this third technique, cones 52A are normally close to emitter-electrode potential $V_{EE}$ and thus are nearly $V_E$ below $V_{WE}$. The magnitude of emitter potential $V_E$ should not be so great that the emitter material of excess layer 52C plates out on cones 52A during the electrochemical removal of excess layer 52C.

Figure 3B:
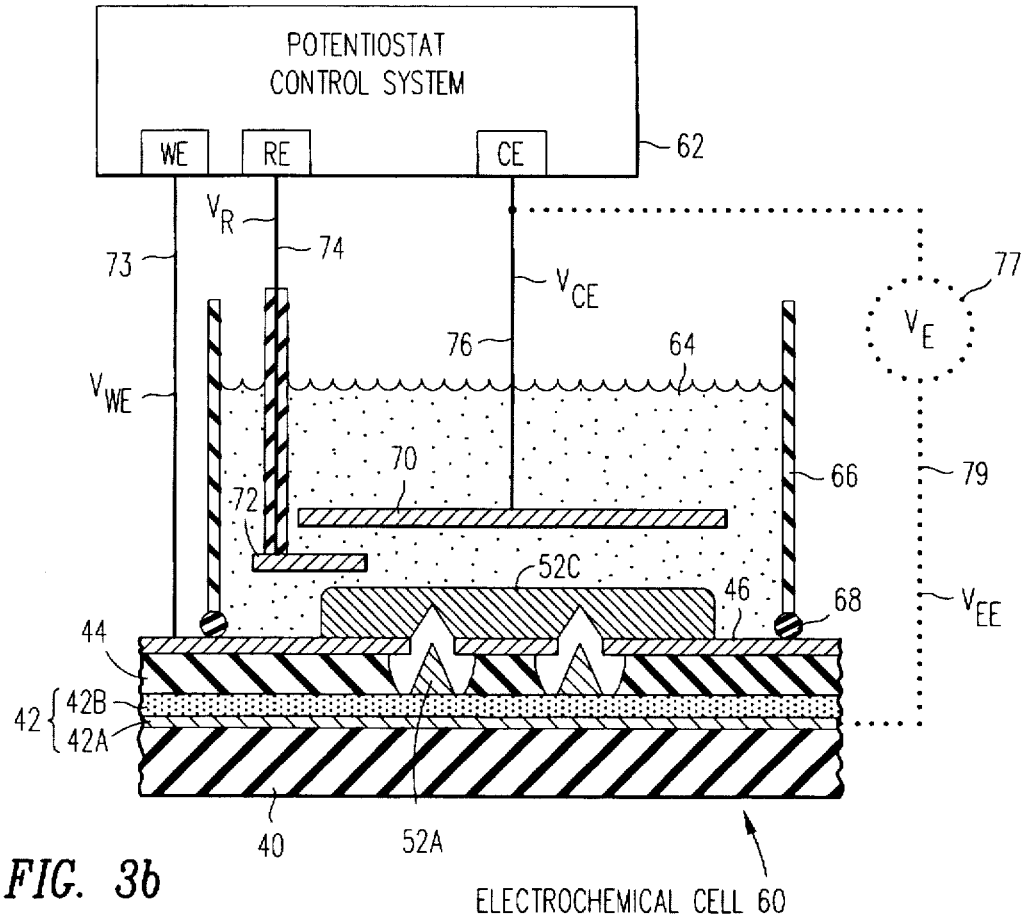

The arrangement of the voltage sources which, relative to reference voltage $V_R$, furnish potentials $V_{WE}$ and $V_{CE}$ and, when utilized, potential $V_{EE}$ to electrochemical cell 60 can be varied as long as the desired value of potentials $V_{WE}$, $V_{CE}$, and $V_{EE}$ are obtained. FIG. 3*b*illustrates an alternative way of implementing the electrochemical removal system of FIG. 3*a*. Electromechanical cell 60 in FIG. 3*b* has a surrounding wall 66 and an O-ring 68 rather than cell wall 65. Electrolytic solution 64 contacts only the top of the field emitter in FIG. 3*b*. O-ring 68 prevents solution 64 from leaking out of cell 60 at the bottom of wall 66.

In the alternative electrochemical system of FIG. 3*b*, working-electrode conductor 73 and (when used) further conductor 79 make electrical connections to the outside of cell 60. Optional voltage source 77 is electrically connected to counter-electrode conductor 76 rather than to working-electrode conductor 73. In order for emitter-electrode potential $V_{EE}$ to be provided to emitter-electrode layer 42A at substantially the same value in both electrochemical removal systems, potential $V_E$ in FIG. 3*a* differs in value from potential $V_E$ in FIG. 3*b*.

With the emitter material of cones 52A and excess layer 52C consisting largely of a refractory metal, such as molybdenum, whose ions have high charge-to-radius values (i.e., essentially high valences for metal ions of close-to-average radius), electrolytic solution 64 is formed with an organic solvent and an acid electrolyte. The organic solvent in electrolytic solution 64 consists of a polar organic room-temperature liquid. In the case of molybdenum, examples of suitable organic solvents for solution 64 are dimethylsulfoxide ("DMSO"), ethanol, and methanol. The highly charged molybdenum ions ($Mo^{6+}$) produced by electrolysis in solution 64 are highly soluble in each of these solvents.

The acid electrolyte in solution 64 can be an inorganic or organic acid. Because sulfur-containing acids have high disassociation constants so as to yield high reaction rates, the acid is typically a sulfur-containing acid. Examples of suitable sulfur-containing inorganic acids are sulfuric acid, sulfurous acid, and sulfamic acid. In the organic-acid case, the sulfur-containing acid is normally a sulfonic acid, typically an aromatic sulfonic acid, particularly one having a benzene ring. An example of a suitable aromatic sulfonic acid having a benzene ring is para-toluenesulfonic acid ("p-TSA").

Electrolytic solution 64 may also contain a salt electrolyte, either organic or inorganic. Inasmuch as organic salts typically dissolve better in organic solvents, the salt electrolyte is normally an organic salt. More particularly, the organic salt is typically an aromatic sulfonic-acid salt, especially one having a benzene ring. Examples of suitable sulfonic-acid salts having benzene rings are tetraethylammonium para-toluenesulfonate ("TEAp-TS"), tetramethylammonium para-toluenesulfonate, and tetrabutylammonium para-tuloene sulfonate.

A desirable example of electrolytic solution 64 for the case in which the emitter material of cones 52A and excess layer 52C consists primarily of molybdenum, while the material of patterned gate layer 46 and (when present) the main control portions of the control electrodes consists primarily of chromium and/or nickel, is:

a. DMSO ($(CH_3)_2SO$) as the organic solvent, b. p-TSA ($CH_3C_4H_4SO_3H$) at a molar concentration (moles/liter) of 0.1–1.5, preferably 0.5, and c. TEAp-TS ($N(CH_2CH_3)_4CH_3C_4H_4S0_3$) at a molar concentration of 0.05–0.75, preferably 0.1.

At the preferred 0.5-molar p-TSA and 0.1-molar TEAp-TS values, voltage source 62A in control system 60 sets anodic potential $V_A$ at a suitable value to fix cell driving potential $V_{WE}$ at a value in the range of 0.2–0.9 volt, typically 0.6 volt, referenced to a Normal Hydrogen Electrode. When voltage source 77 is actively used in the electrochemical system of FIG. 3*a* with potential $V_{WE}$ at the typical 0.6-volt value, emitter potential $V_E$ equals 0.4–2.4 volts, typically 0.5 volt, in order to set emitter-electrode potential $V_{EE}$ at this $V_E$ amount below working-electrode potential $V_E$.

DMSO has a boiling point of nearly 190° C. As a result, the electrolysis with the preceding example of solution 64 can be conducted at a temperature in excess of 100° C., the boiling point of water. The rate of removal of excess emitter-material layer 52C is quite high. Since DMSO is flammable, the electrolysis is performed a safe distance below the DMSO boiling point. With DMSO as the solvent, the electrochemical removal is usually performed at 20–120° C., typically 40–60° C.

By operating electrochemical cell 60 at the preceding conditions, the driving force provided by anodic driving potential $V_{WE}$ causes the molybdenum in excess emitter-material layer 52C to be anodically oxidized, and thereby dissolved in electrolytic solution 64, typically as $Mo^{6+}$ ions. Accordingly, excess layer 52C is electrochemically removed from the top of the structure. The p-TSA is employed to adjust the rate at which the molybdenum in excess layer 52C is oxidized and thereby removed from the field-emission structure. Increasing the p-TSA concentration increases the rate at which the molybdenum in layer 52C is oxidized at a given value of potential $V_{WE}$, and vice versa. Hydrogen ions ($H^+$) are reduced at counter electrode 70 to produce hydrogen gas.

As indicated above, a small fraction of electron-emissive cones 52A are electrically short circuited to excess emitter-material layer 52C directly or through gate layer 46. Such an electrical short typically occurs as a result of a cone 52A being forced into contact with gate layer 46, or as a result of one or more electrically conductive particles lodging between that cone 52A and layer 46 or 52C. The conductive particles typically consist of emitter cone material that breaks off excess layer 52C.

Each cone 52A shorted to excess layer 52C receives working-electrode potential $V_{WE}$. When emitter-electrode layer 42A is self-biased to a potential below $V_{WE}$ or is actively maintained by optional voltage source 77 at a potential ($V_{EE}$) below $V_{WE}$, the difference between potential $V_{WE}$ and the emitter-electrode potential during the electrochemical removal operation is largely dropped across the portion of impedance component 42B underlying that shorted cone 52A. Consequently, each shorted cone 52A is electrochemically attacked until a sufficient amount of emitter material has been removed from excess layer 52C and that cone 52A to produce a suitably wide gap between the then-existing remainder of excess layer 52C and any remainder of that cone 52A. When the gap reaches such a width that the potential on originally shorted cone 52A drops below the value needed to electrochemically remove material, the attack on that cone 52A terminates.

The electrochemical attack on a shorted cone 52A sometimes terminates when only a relatively small portion of that cone 52A has been removed. Depending on how much of a previously shorted cone 52A remains and how that remainder is shaped, the remaining portion of that cone 52A may be able to function adequately as an electron-emissive element. In any event, shorts between cones 52A and excess layer 52C are eliminated (repaired) by using the present electrochemical procedure to remove layer 52C.

At the potentials and currents present during the electrochemical removal of excess emitter-material layer 52C, the impedance of impedance component 42B is sufficiently high that all of cones 52A not shorted to excess emitter-material layer 52C are effectively electrically isolated from one another and, importantly, from any cone 52A shorted to excess layer 52C. In particular, an unshorted cone 52A can be electrochemically attacked only if there is a current path by which electrons generated during the oxidation of that cone's material can reach some part of the expanded working electrode formed with gate layer 46, excess layer 52C, the main control portions (when present), and any shorted cones 52A. The high impedance of component 42B during the electrochemical removal operation virtually closes any current path from an unshorted cone 52A through emitter-electrode layer 42A to a shorted cone 52A.

Depending on how close the potential on emitter-electrode layer 42A can come to driving potential $V_E$, the impedance of component 42B is controlled so that the cumulative short-circuit current of a number of shorted cones 52A, e.g., 1–2% of total cones 52A, is insufficient to result in the removal of any significant amount of the material of unshorted cones 52A. Normally, there is no significant current path outside of each shorted cone 52A for carrying the current needed to electrochemically attack unshorted cones 52A. Consequently, substantially no chemical activity occurs at the surfaces of unshorted cones 52A.

When the potential on emitter-electrode layer 42A is unregulated and can potentially get close to $V_{WE}$, the high impedance provided by component 42B during the electrochemical removal operation functions largely on its own to prevent the electrochemical removal of unshorted cones 52A. Self biasing or actively maintaining layer 42A at a suitable potential, typically in the vicinity of 0.5 volt below $V_{WE}$, provides impedance component 42B with electrolytic assistance in protecting unshorted cones 52A. In essence, use of the self-biasing or active-potential-maintenance technique makes it harder for unshorted cones 52A to reach a potential at which they could be electrochemically removed, thereby relaxing the requirements on component 42B. That is, the impedance of component 42B during the electrochemical removal operation can be somewhat lower than with the unregulated technique.

An example is helpful. When impedance component 42B consists of electrically resistive material, component 42B provides an impedance $Z_B$ of at least $10^6$–$10^{11}$ ohms, typically $10^9$ ohms, between emitter-electrode layer 42A and each cone 52A during normal display operation. Component 42B is configured to provide impedance $Z_B$ at a considerably higher value during the electrochemical removal of layer 52C. Specifically, component 42B provides high impedance to (positive) current flow upward into an unshorted cone 52A. With the unregulated technique, impedance $Z_B$ is typically in the vicinity of $10^{11}$ ohms or more during the removal of excess layer 52C. When the self-biasing or the active-potential-maintenance technique is employed to place layer 42A at a potential volt below $V_{WE}$, the minimum value of impedance $Z_B$ during the electrochemical removal depends on the number of shorted cones 52A and the specifics of the electrochemistry.

In an electrochemical removal cell, the (positive) anodic current $I_{WE}$ that flows through the working electrode is indicative of the rate at which material is electrochemically removed from a structure subjected to the electrolytic solution and driving potential. The removal rate normally increases with increasing anodic current $I_{WE}$.

Figure 4A:
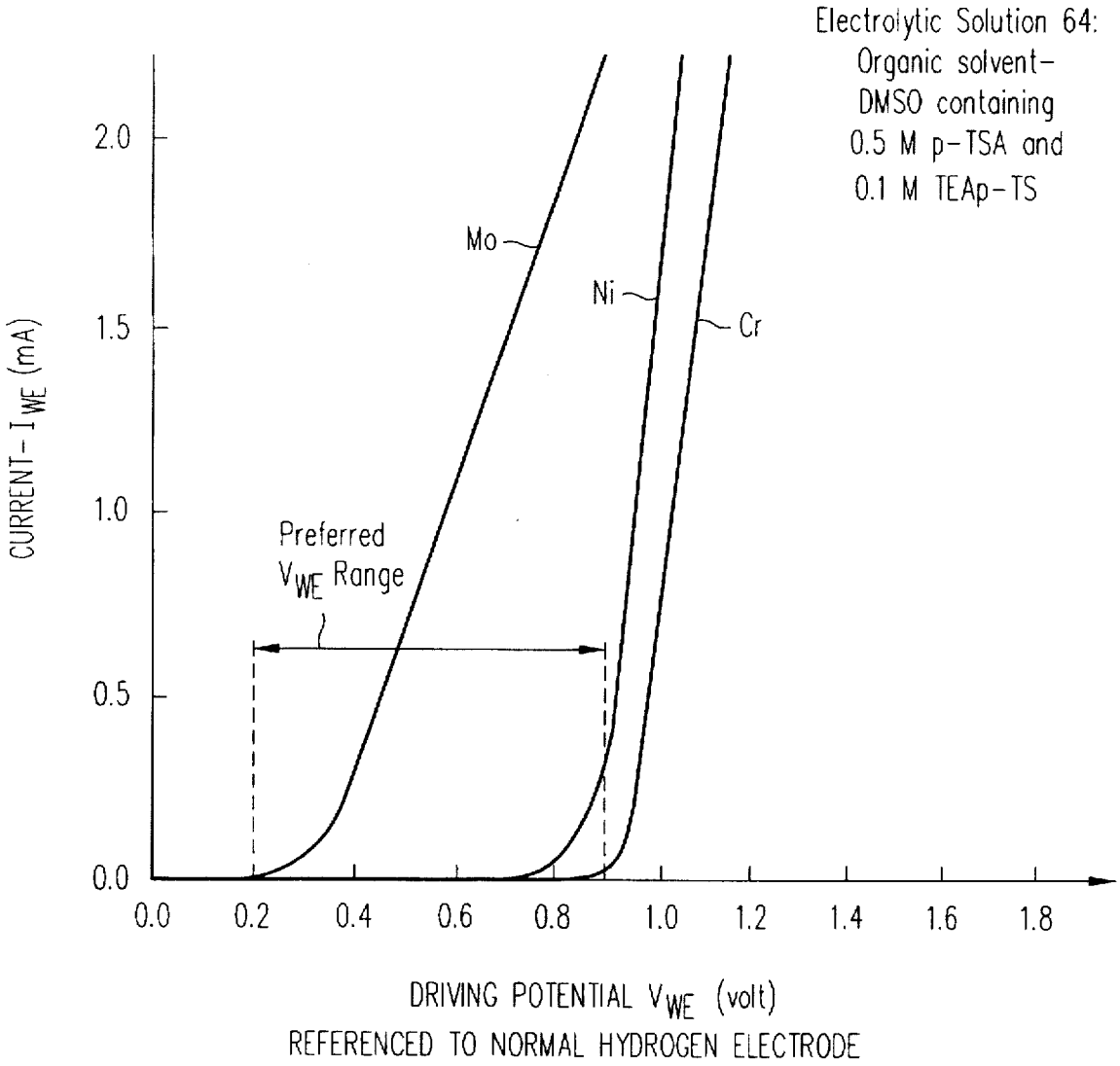
FIGS. 4*a* and 4*b* are graphs of cell current as a function of driving voltage for electrochemically removing certain metals in a potentiostatic electrochemical system of the type shown in FIG. 3*a* or 3*b*.

The preferred $V_{WE}$ potential range given above at the preferred 0.5-mole p-TSA and 0.1-mole TEAp-TS values was determined by experimentally monitoring anodic polarization curves (current $I_{WE}$ as a function of applied driving potential $V_{WE}$) for an electrochemical cell separately configured to remove specimens of molybdenum, chromium, and nickel. FIG. 4*a* illustrates the experimental results, indicating that the removal rates for chromium and nickel are very small compared to the removal rate for molybdenum when driving potential $V_{WE}$ is in the range of 0.2–0.9 volt referenced to a Normal Hydrogen Electrode.

Another implementation of electrolytic solution 64 that employs an organic solvent when cones 52A and excess layer 52C are formed with molybdenum, while gate layer 46 and (when present) the adjoining main control portions consist of chromium and/or nickel, is:

a. Ethanol ($CH_3CH_2OH$) as the solvent, and b. Sulfuric acid ($H_2SO_4$).

With a suitable molar concentration being chosen for the sulfuric acid, excess layer 52C is electrochemically removed generally in the manner described above.

In the case where cones 52A and excess layer 52C consists of molybdenum, while patterned gate layer 46 and (when present) the adjoining main control portions are formed with chromium or/and nickel, electrolytic solution 64 can alternatively be an aqueous solution containing:

a. Sodium hydroxide (NaOH) at a molar concentration of 0.005–0.05, typically 0.01, and b. Sodium nitrate ($NaNO_3$) at a molar concentration of 0.005–3.0, typically 2.0.

Figure 4B:
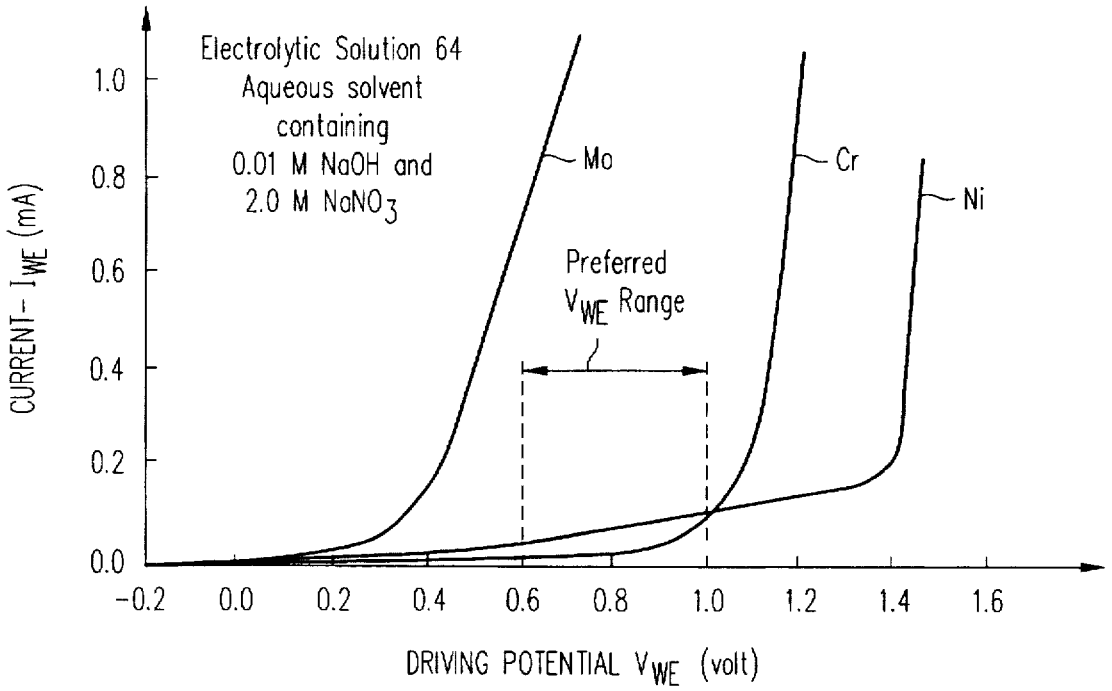

At the typical 0.01-mole NaOH and 2.0-mole $NaNO_3$ values, anodic potential $V_A$ is set at a suitable value by control system 62 to fix cell driving potential $V_{WE}$ at a value in the range of 0.6–1.0 volt, typically 0.8 volt, referenced to a Normal Hydrogen Electrode. This range was determined experimentally in the manner described above. The experimental results are presented in FIG. 4*b*. The removal rates for chromium and nickel are very small compared to that for molybdenum when, as shown in FIG. 4*b*, driving potential $V_{WE}$ is in the indicated 0.6–1.0 volt range.

With electrochemical cell 60 being operated at the conditions given in the preceding paragraph, excess layer 52C is electrochemically removed from the structure. The driving force provided by anodic potential $V_{WE}$ causes the molybdenum in layer 52C to be oxidized and dissolved in electrolytic solution 64, typically as Mo(VI) ions. The sodium nitrate is used to adjust the molybdenum oxidation. The $NO_3^-$ ions produced by dissociation of $NaNO_3$ act as the oxidizing agent. Increasing the $NaNO_3$ concentration increases the rate at which the molybdenum in layer 52C is oxidized, and vice versa. Reduction of hydrogen ions again occurs at counter electrode 70 to produce hydrogen gas.

Figure 5A:
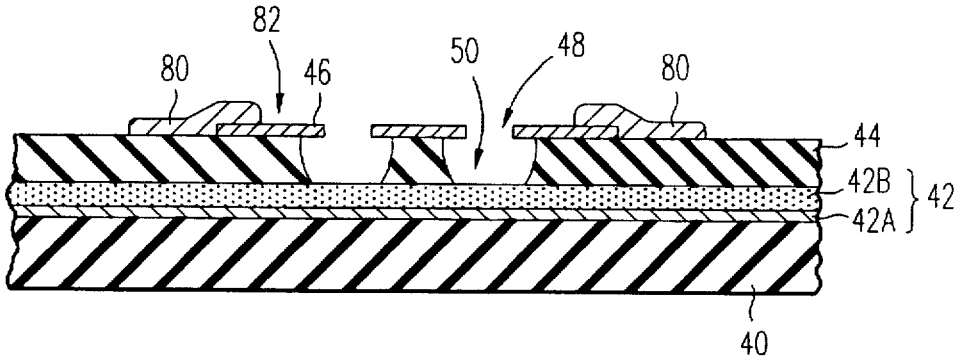
FIGS. 5*a*–5*d* are cross-sectional structural views representing steps in an implementation of the process sequence of FIGS. 2*a*–2*c*.

FIGS. 5*a*–5*d* (collectively "FIG. 5") illustrate an implementation of the process sequence of FIG. 2 for the case in which the field emitter is provided with separate electrically conductive main control portions 80 that contact patterned gate layer 46. FIG. 5*a* depicts one such main control portion 80 that extends perpendicular to the plane of the figure. The combination of a main control portion 80 and the portion(s) of gate layer 46 adjoining that main portion 80 form a composite control electrode 46/80. A group of large control apertures 82, one of which is shown in FIG. 5*a*, extend through each main control portion 80. Each large control aperture 82 exposes a multiplicity of composite openings 48/50. The emitter electrodes of non-insulating region 42A in FIG. 5*a* extend horizontally, parallel to the plane of the figure.

Figure 5B:
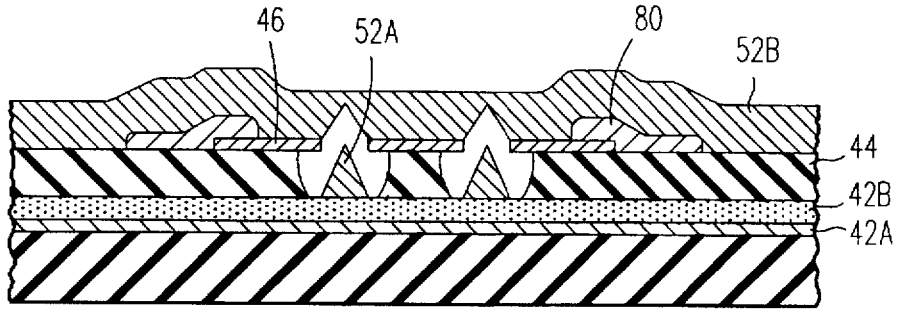

The appearance of the partially finished field-emission structure after the deposition of cones 52A and blanket excess emitter-material layer 52B is shown in FIG. 5*b*. In addition to contacting the portions of gate layer 46 previously exposed through large control apertures 82, excess layer 52B is situated on main control portions 80 and on parts of insulating layer 44.

Figure 5C:
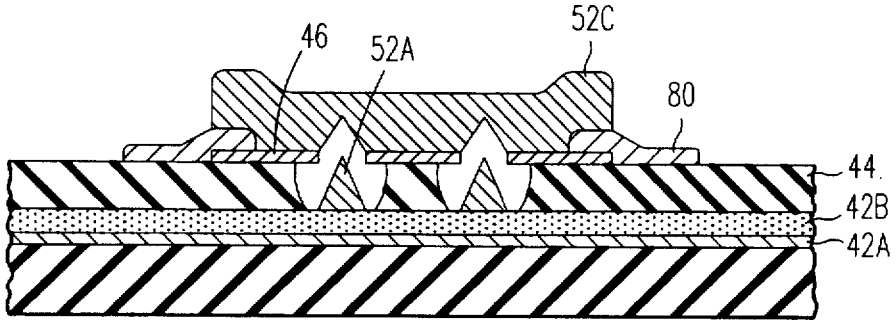
Figure 6A:
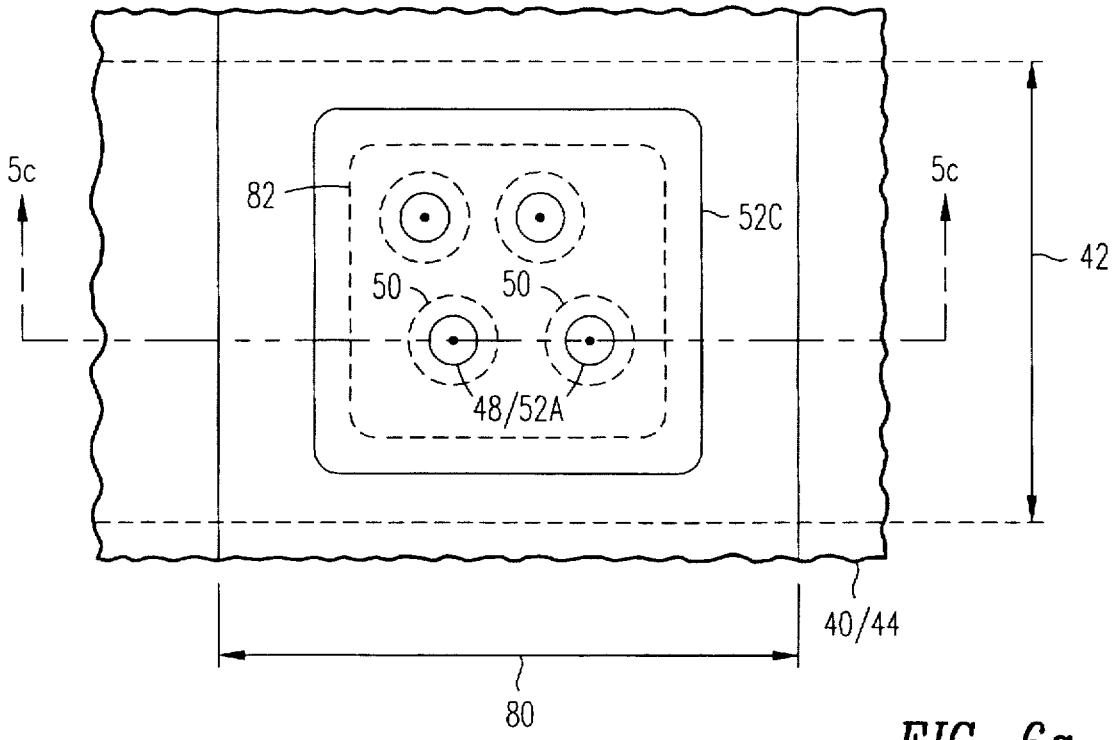
FIGS. 6*a* and 6*b* are layout views of the respective structures in FIGS. 5*c* and 5*d*. The cross section of FIG. 5*c* is taken through plane 5*c*—5*c* in FIG. 6*a*. The cross section of FIG. 5*d* is taken through plane 5*d*—5*d* in FIG. 6*b*.

FIG. 5*c* illustrates how the structure appears after performing the masked etch to remove part of excess emitter-material layer 52B, including excess emitter material situated along the lateral periphery of the structure. The remainder of excess layer 52B consists of a group of rectangular islands 52C that overlie corresponding portions of gate layer 46. A layout (plan) view of FIG. 5*c* is depicted in FIG. 6*a*. By using the same reticle to create the photoresist mask employed in forming excess emitter-material islands 52C as used in patterning the gate material to form patterned gate layer 46, the outside boundary of each island 52C is generally in vertical alignment with the outside boundary of the underlying portion of gate layer 46.

Figure 5D:
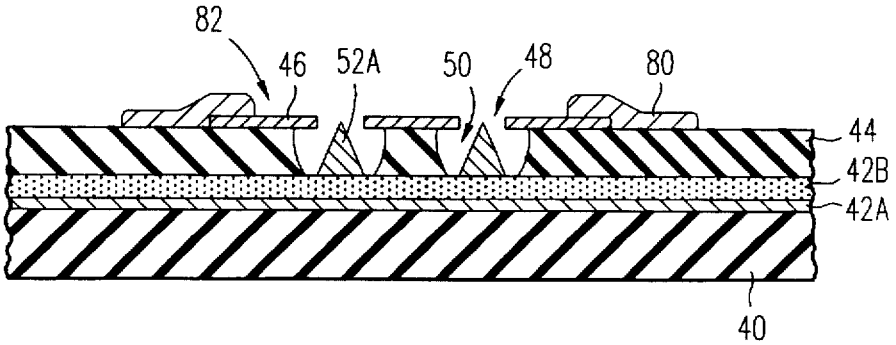
Figure 6B:
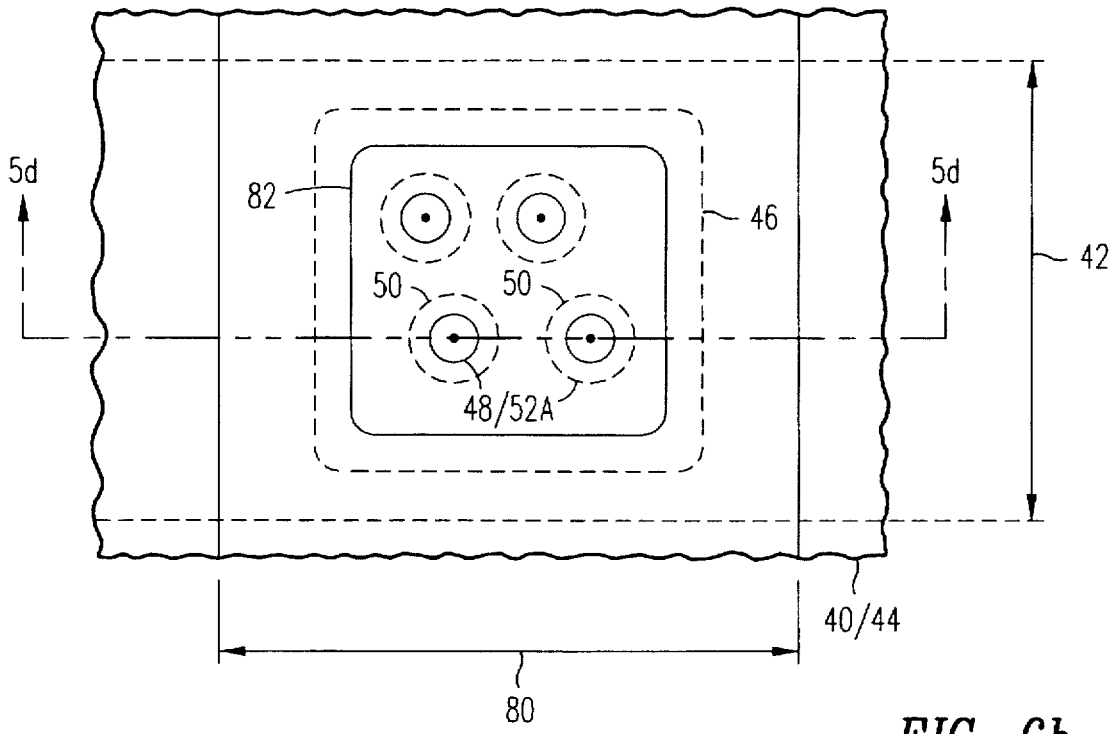

FIG. 5*d* illustrates the appearance of the structure after electrochemically removing each island 52C using the impedance-assisted technique of the invention. As indicated in FIG. 5*d*, neither gate layer 46 nor main control portions 80 are substantially electrochemically attacked during the removal of layers 52C. Similarly, unshorted cones 52A are not significantly electrochemically attacked during the removal operation, the attack (if any) on unshorted cones 52A being much less than the (very small) attack on control portions 46 and 80. A layout view corresponding to the structure of FIG. 5*d* is depicted in FIG. 6*b*.

Figure 7:
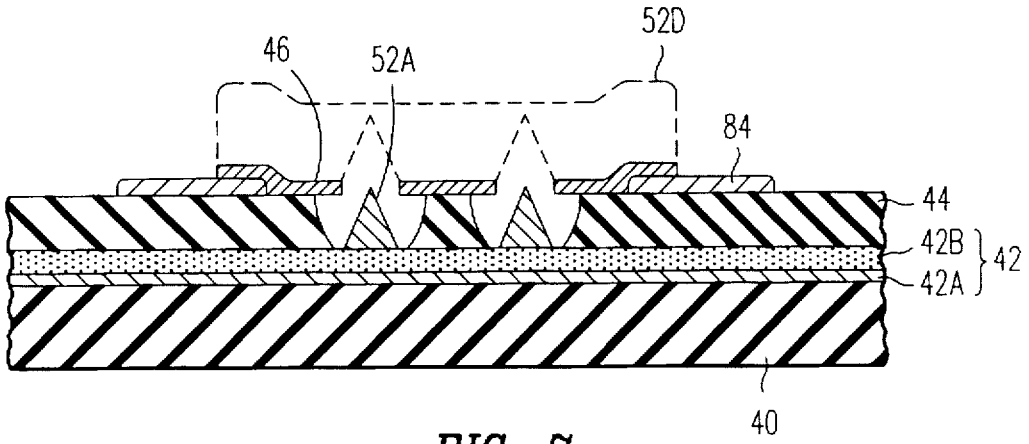
FIG. 7 is a cross-sectional structural view of a structure produced according to another implementation of the process sequence of FIGS. 2*a*–2*c*.

In the process sequence of FIG. 5, main control portions 80 are situated on parts of patterned gate layer 46. Alternatively, gate layer 46 can overlie parts of the main control portions. FIG. 7 depicts such an alternative in which gate layer 46 extends partly over a group of electrically conductive main control portions 84 extending perpendicular to the plane of the figure. Item 52D, shown in dashed line in FIG. 7, indicates the remainder of excess emitter-material layer 52B after the masked patterning etch. The shape of excess layer 52D is nearly the same as the shape of excess layer 52C in the process sequence of FIG. 5*c*.

The impedance characteristics of impedance component 42B are chosen in such a way as to enhance the flat-panel display performance during normal operation of the present field emitter, including providing the display with protection against short circuits, and to enhance the ability to remove excess emitter-material layer 52C without removing any significant amount of the material of unshorted cones 52A. During normal display operation, component 42B provides the display with protection against an electrically shorted cone 52A by limiting the resultant short-circuit current to a value low enough to avoid excessive power consumption and to avoid significantly impacting the brightness level achieved with other cones 52A in the same large control aperture 82 as the shorted cone 52A.

In looking specifically at the impedance characteristics of component 42B, let $V_{GE}$ represent the voltage between gate layer 46 and the emitter electrodes of layer 42A. Let $V_Z$ represent the voltage across the thickness of impedance component 42B below any one of electron-emissive cones 52A. Impedance voltage $V_Z$ is one component of gate-to-emitter voltage $V_{GE}$. Nearly all of the $V_{GE}$ drop for a particular unshorted cone 52A occurs across the gap between gate layer 46 and that cone 52A. Impedance voltage $V_Z$ for an unshorted cone 52A is thus much smaller than gate-to-emitter voltage $V_{GE}$.

The pixels in the flat-panel display usually have multiple levels of gray-scale brightness corresponding to different values of gate-to-emitter voltage $V_{GE}$. Let $V_{ZL}$ represent the operating $V_Z$ value that occurs at the minimum pixel brightness level during normal display operation. At a typical maximum $V_{GE}$ level of 35 volts, lower operating value $V_{ZL}$ is typically 1 volt or less. Let $V_{ZU}$ represent the upper $V_Z$ value that occurs during normal display operation. Although shorted cones 52A are automatically repaired in using the present invention, some shorted cones 52A are typically present during normal display operation. For a shorted cone 52A, substantially the entire value of its gate-to-emitter voltage $V_{GE}$ is present across impedance component 42B. Upper operating value $V_{ZU}$ is typically the maximum value of voltage $V_{GE}$. Accordingly, $V_{ZU}$ is typically 35 volts.

Impedance $Z_B$ is the vertical impedance that component 42B presents to a current $I_Z$ flowing through the thickness of component 42B, where current $I_Z$ is the current of a single cone 52A. The characteristics of component 42B are chosen so that vertical impedance $Z_B$ is high when the magnitude (absolute value) of impedance voltage $V_Z$ is in the vicinity of electrochemical removal value $V_{ZR}$ and, compared to the $V_{ZR}$ value, is relatively low when voltage $V_Z$ is in the normal operational range from lower operating value $V_{ZL}$ to upper operating value $V_{ZU}$. Specifically, impedance $Z_B$ is high when voltage $V_Z$ is in the vicinity of $-Z_{BR}$. Note that the field emitter is not normally subjected to $V_Z$ values in the vicinity of $-V_{ZU}$ to $-V_{ZL}$. Accordingly, the characteristics of component 42B at $V_Z$ values in the vicinity of $-V_{ZU}$ to $-V_{ZL}$ are not of interest here.

The $Z_B$ dependence on impedance voltage $V_Z$ can be expressed mathematically utilizing a transition $V_Z$ value lying between electrochemical removal value $V_{ZR}$ and lower operating value $V_{ZL}$. Letting $V_{ZT}$ represent this transition value, the magnitude of vertical impedance $Z_B$ is (a) greater than a transition value $Z_{BT}$ when impedance voltage $V_Z$ is between $-V_{ZT}$ and zero and (b) less than transition value $Z_{BT}$ when voltage $V_Z$ is between $V_{ZT}$ and $V_{ZU}$. The magnitude of impedance $Z_B$ is also typically, but usually not necessarily, greater than $Z_{BT}$ when voltage $V_Z$ is between zero and $V_{ZT}$. Note that the $Z_B$ characteristics are not specified for the region in which impedance voltage $V_Z$ is less than $-V_{ZT}$. This is consistent with the fact that the variation of impedance $Z_B$ for $V_Z$ values in the vicinity of $-V_{ZU}$ to $-V_{ZL}$ is not of interest here. In the positive $V_Z$ range from $V_{ZL}$ to $V_{ZU}$, the magnitude of impedance $Z_B$ is typically largely constant. Since impedance $Z_B$ varies with voltage $V_Z$, the current-voltage characteristics ("I-V") characteristics of impedance component 42B are non-linear, normally highly non-linear.

By arranging for impedance component 42B to have the preceding non-linear I-V characteristics, the magnitude of impedance $Z_B$ is sufficiently low during normal device operation that current $I_Z$ can readily reach the values needed to achieve the desired pixel brightness levels. On the other hand, when the magnitude of impedance voltage $V_Z$ is at the considerably lower value $V_{ZR}$ that occurs during the electrochemical removal of excess layer 52C, the magnitude of impedance $Z_B$ increases sufficiently to cause unshorted cones 52A to be effectively electrically isolated from one another and from any shorted cones 52A. Any electrical shorting of cones 52A to excess layer 52C thus does not hinder the electrochemical removal operation or damage unshorted cones 52A.

FIGS. **8*a*–8*d* illustrate four different ways of implementing impedance component 42B** to achieve the preceding I-V characteristics.

In FIG. **8*a*, component 42B consists of a layer 90 of electrically resistive material. Letting $R_B$ be the vertical resistance of resistive layer 90, vertical resistance $R_B$ is then (a) greater than a transition resistance value $R_{BT}$ when voltage $V_Z$ is between $-V_{ZT}$ and zero and (b) less than $R_{BT}$ when voltage $V_Z$ is between $V_{ZT}$ and $V_{ZU}$. The I-V characteristics of resistive layer 90** are normally symmetric about the zero-$I_Z$ point. Accordingly, resistance $R_B$ is greater than $R_{BT}$ when voltage $V_Z$ is between zero and $V_{ZT}$.

Resistive layer 90 can be formed with cermet (i.e., metallic particles embedded in ceramic) or a silicon-carbon compound such as silicon-carbon-nitrogen. Other candidates for layer 90 include lightly doped polycrystalline semiconductor material (such as polycrystalline silicon), intrinsic amorphous semiconductor material (such as intrinsic amorphous silicon), large-bandgap semiconductor material, aluminum nitride, and gallium nitride.

Impedance component 42A is configured as a two-layer resistor in FIG. **8*b*. The two-layer resistor consists of a lower electrically resistive layer 92 and an upper electrically resistive layer 94. Resistor 92/94 has the same basic resistive I-V characteristics as given above for resistive layer 90. Lower resistive layer 92 provides resistor 92/94 with the generally linear I-V characteristics for the $I_Z$ range from $I_{ZL}$ to $I_{ZU}$ during normal display operation. Upper resistor 94, which typically consists of cermet, largely provides the increased vertical resistance needed during the electrochemical removal operation. Further information on resistor 92/94** is given in Knall et al, co-filed U.S. patent application Ser. No. 08/884,702, the contents of which are incorporated by reference herein.

In FIG. **8*c*, impedance component 42B consists of a diode formed with an upper anode layer 96 and a lower cathode layer 98. Current flows downward through diode 96/98 during normal display operation. Diode 96/98 is typically a semiconductor diode having a threshold voltage $V_T$ less than 0.9 volt. When impedance voltage $V_Z$ is greater than $V_T$, current flows through diode 96/98 and is limited by the internal resistance of anode 96 and cathode 98. When the magnitude of impedance voltage $V_Z$ is less than zero (i.e., diode 96/98 is reversed biased), substantially no current flows through diode 96/98. In effect, the internal resistance of diode 96/98** is very high when voltage $V_Z$ is negative.

Impedance component 42A is configured to implement a capacitor in FIG. **8*d*. The capacitor consists of an upper electrically conductive plate 100, a dielectric layer 102, and a lower plate formed with emitter electrode 42A. Upper plate 100 could be eliminated. Electron-emissive element 52A then form the upper plate. The I-V characteristics for impedance component 42B are met with capacitor 100/102/104** due to the switching/non-switching nature of how the flat-panel display is utilized during normal display operation and during the electrochemical removal operation.

Figure 9:
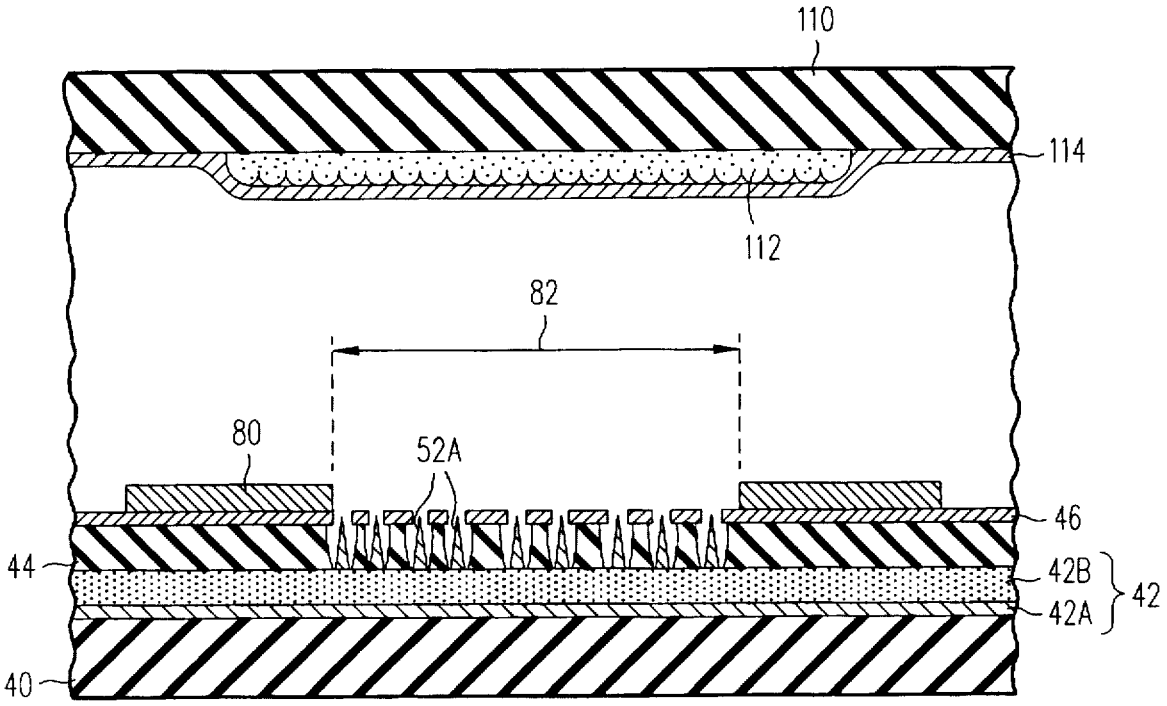
FIG. 9 is a cross-sectional structural view of a flat-panel CRT display that includes a gated field emitter having electron-emissive elements fabricated in accordance with the invention.
Figure 8A:
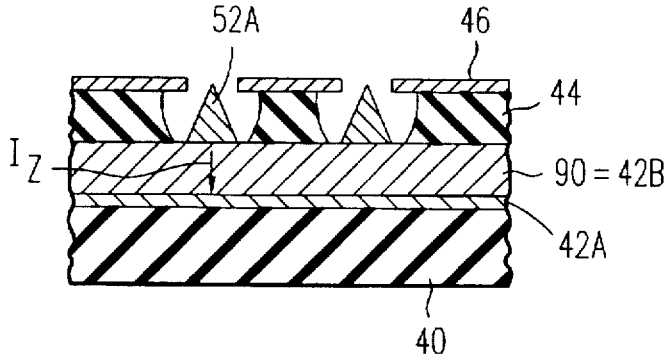
FIGS. 8*a*–8*d* are cross-sectional views of implementations for the emitter impedance component in the field emitter manufactured according to the process of FIGS. 2*a*–2*c* or 5*a*–5*d*.
Figure 8B:
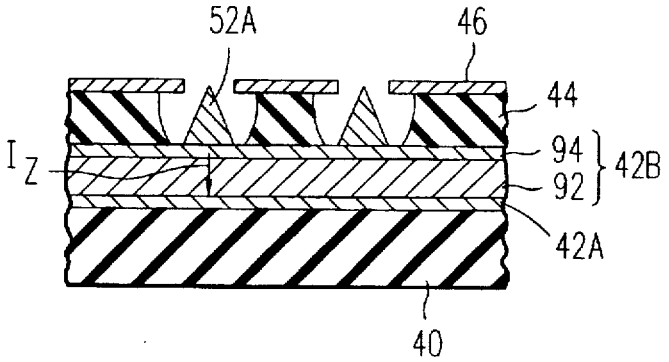
Figure 8C:
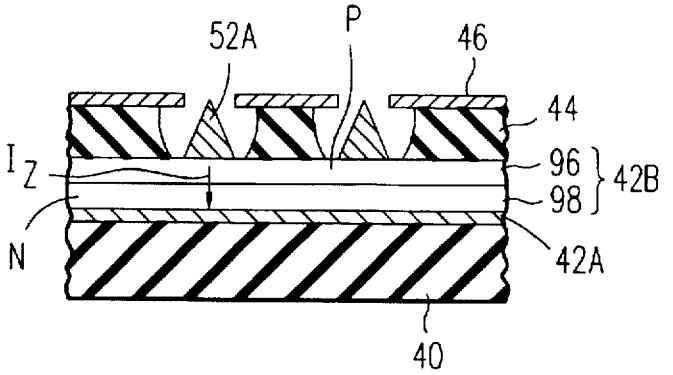
Figure 8D:
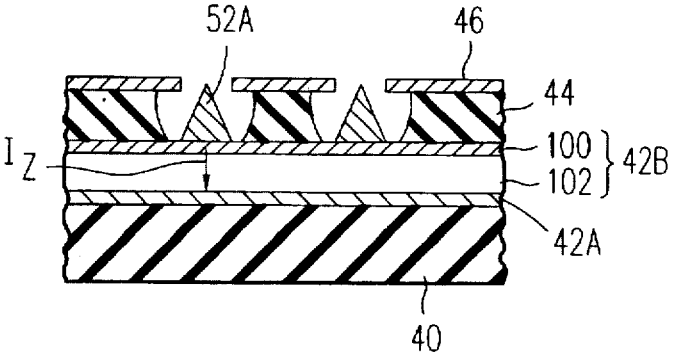

FIG. 9 depicts a typical example of the core active region of a flat-panel CRT display that employs an area field emitter, such as that of FIG. **5*d*(or 7), manufactured according to the invention. Substrate 40 forms the backplate for the CRT display. Emitter region 42 is situated along the interior surface of backplate 40. One main control portion 80 is depicted in FIG. 9**.

A transparent, typically glass, faceplate 110 is located across from baseplate 40. Light-emitting phosphor regions 112, one of which is shown in FIG. 9, are situated on the interior surface of faceplate 110 directly across from corresponding large control apertures 82. A thin light-reflective layer 114, typically aluminum, overlies phosphor regions 112 along the interior surface of faceplate 110. Electrons emitted by electron-emissive elements 52A pass through light-reflective layer 114 and cause phosphor regions 112 to emit light that produces an image visible on the exterior surface of faceplate 110.

The core active region of the flat-panel CRT display typically includes other components not shown in FIG. 9. For example, a black matrix situated along the interior surface of faceplate 110 typically surrounds each phosphor region 112 to laterally separate it from other phosphor regions 112. Focusing ridges provided over interelectrode dielectric layer 44 help control the electron trajectories. Spacer walls are utilized to maintain a relatively constant spacing between backplate 40 and faceplate 110.

When incorporated into a flat-panel CRT display of the type illustrated in FIG. 9, a field emitter manufactured according to the invention operates in the following way. Light-reflective layer 114 serves as an anode for the field-emission cathode. The anode is maintained at high positive potential relative to the gate and emitter lines.

When a suitable potential is applied between (a) a selected one of emitter row electrodes 42A and (b) a selected one of the column electrodes constituted partially or fully with gate layer 46, the so-selected gate portion extracts electrons from the electron-emissive elements at the intersection of the two selected electrodes and controls the magnitude of the resulting electron current. Desired levels of electron emission typically occur when the applied gate-to-cathode parallel-plate electric field reaches 20 volts/mm or less at a current density of 0.1 $mA/cm^2$ as measured at the phosphor-coated faceplate in the display when phosphor regions 112 are high-voltage phosphors. Upon being hit by the extracted electrons, phosphor regions 112 emit light.

Directional terms such as "lower" and "upper" have been employed in describing the present invention to establish a frame of reference by which the reader can more easily understand how the various parts of the invention fit together. In actual practice, the components of an electron-emitting device may be situated at orientations different from that implied by the directional terms used here. The same applies to the way in which the fabrication steps are performed in the invention. Inasmuch as directional terms are used for convenience to facilitate the description, the invention encompasses implementations in which the orientations differ from those strictly covered by the directional terms employed here.

While the invention has been described with reference to particular embodiments, this description is solely for the purpose of illustration and is not to be construed as limiting the scope of the invention claimed below. For example, metals different from the preferred ones specified above can be selected for the emitter material of electron-emissive cones 52A and for the gate/column materials of gate layer 46 and (when present) the separate main control portions 80 or 84 by performing electrochemical removal tests on candidate metals using different electrolytic solution compositions and then examining the results, as in FIGS. 4*a* and 4*b*, to determine appropriate ranges of driving potential $V_{WE}$.

An electrochemical removal system containing a working-electrode conductor, a counter electrode, a counter-electrode conductor analogous to conductor 76, and an optional counter electrode conductor analogous to conductor 79, but no reference electrode (or reference-electrode conductor), can be used in place of the electrochemical removal system of FIG. 3*a* or 3*b*. This variation simplifies the operational procedure and is particularly suitable for production-scale fabrication of electron emitters. Alternatively or additionally, it may be possible to delete counter electrode 70 (and associated conductor 76) in certain situations to achieve further simplification.

A counter electrode can be provided in the electron emitter itself, as part of substrate 40, instead of being situated in electrolytic solution 64 above excess layer 52C. Optional counter-electrode conductor 79 can be connected to a separate terminals on control system 62 rather than being commonly connected through terminal WE in FIG. 3*a* or terminal CE in FIG. 3*b*.

A galvanostatic (constant-current) electrochemical removal system can be used in place of the potentiostatic system described above. Potentiostat control system 62 of FIG. 3*a* or 3*b* is then replaced with a galvanostatic control system containing a current source that causes a substantially constant current to flow in working-electrode conductor 73 and counter-electrode conductor 76. Because the potential between working-electrode conductor 73 and counter electrode 70 in a galvanostatic system could rise to a value sufficient to electrochemically remove gate layer 46 and/or (when present) the separate main control portions, the electrochemical removal operation is typically terminated after a pre-selected removal time. Alternatively, a potential-measuring device can be included in the system for causing the removal process to terminate upon reaching a pre-selected potential between those of conductors 73 and 76.

The electrochemical removal system of FIG. 3*a* or 3*b* can be modified to cause a controllable potential to exist between working-electrode conductor 73 and counter-electrode conductor 76 rather than holding conductor 73 at a fixed potential. The potential between conductors 73 and 76 can be set at a fixed value during operation or could be programmably controlled.

Impedance component 42B can be formed with three or more electrically resistive layers. Combinations of resistors, capacitors, diodes, and other such basic electrical elements can be employed to form impedance component 42B.

The processes of FIGS. 2 and 5 can be revised to make electron-emissive elements of non-conical shape. As an example, the deposition of the emitter material can be terminated before fully closing the openings through which the emitter material enters dielectric openings 52. Electron-emissive elements 52A are then formed generally in the shape of truncated cones. The electrochemical removal operation of the invention is subsequently performed on excess emitter-material layer 52C with truncated cones 52A initially exposed to electrolytic solution 64 through apertures in layer 52C.

The organic solvent in electrolytic solution 62 can be formed with two or more organic liquids. Also the acid can be formed with two or more acids, typically two or more organic acids. Two or more salts, typically organic salts, can likewise be used in solution 64.

Any one or more of lithium nitrate ($LiNO_3$) potassium nitrate ($KNO_3$), rubidium nitrate ($RbNO_3$), and cesium nitrate ($CsNO_3$) can be substituted for, or utilized in combination with, sodium nitrate as the source of oxidizing ions in an aqueous implementation of electrolytic solution 64. Likewise, any one or more of lithium hydroxide (LiOH), potassium hydroxide (KOH), rubidium hydroxide (RbOH), and cesium hydroxide (CsOH) can be substituted for, or employed in combination with, sodium hydroxide as the base in solution 64. Any one or more of the oxidizing agents can be used with any one or more of the bases. For any of these substitutions or combinations, the total molar concentrations of the oxidizing agents and bases are then respectively the same as described above for sodium nitrate and sodium hydroxide.

Nitrates of one or more Group II metals, particularly magnesium, calcium, strontium, and barium, can be used in an aqueous implementation of electrolytic solution 64 instead of, or in addition to, the Group I metal nitrates described above. Likewise, hydroxides of one or more of these Group II metals can be used in solution 64 in place of, or in addition to, the Group I metal hydroxides described above.

When performing the masked etch on blanket excess emitter-material layer 52B (prior to the electrochemical removal operation), the masked etch can be performed in such a way that (a) substantially all of each main control portion 80 is covered with excess emitter material rather than leaving only islands 52C of excess emitter material on control portions 80 and (b) the excess emitter material is removed from the areas between control portions 80. The electrochemical removal procedure of the invention may be performed long enough to create openings through patterned excess-emitter material layer 52C for exposing electron-emissive cones 52A but not long enough to remove all of layer 52C. By combining the two preceding variations, the remaining excess emitter material situated on control portions 80 can serve as parts of portions 80 to increase their current-conduction capability.

It may be desirable that electron-emissive cones have tips formed with emitter material, such as refractory metal carbide, that cannot readily be directly electrochemically removed. Titanium carbide is an attractive refractory carbide for the tips of the electron-emissive cones. In such a case, electrically non-insulating emitter material (such as molybdenum) that can be electrochemically removed is deposited over the top of the structure at the stage shown in FIG. 2*a* or 5*a* and into dielectric openings 50 to form truncated conical bases for electron-emissive elements. The cone formation process is then completed by depositing the non-electrochemically removable material on top of the structure and into openings 50 until the apertures through which the material enters openings 50 fully close.

An electrochemical removal operation is then performed in the manner described above to remove the excess electrochemically removable emitter material situated directly on gate layer 46 and (when present) the separate main control portions. During this operation, the excess non-electrochemically removable emitter material located along the top of the structure is lifted off. Consequently, conical electron-emissive elements having bases of electrochemically removable emitter material and tips of non-electrochemically removable emitter material are exposed through gate openings 48.

Provided that layer 32 in the prior art process of FIG. 1 consists of electrochemically removable material, the principles of the invention can be extended to electrochemically removing an intermediate layer, such as layer 32, situated between a gate layer and a layer containing excess emitter material. In such an extension, the excess material layer is typically lifted off as a result of removing the intermediate layer. Any of the electrochemical removal systems described above can be employed in the so-extended process sequence.

Substrate 40 can be deleted if emitter region 42 is of sufficient thickness to support the structure. Insulating substrate 40 can be replaced with a composite substrate in which a thin insulating layer overlies a relatively thick non-insulating layer that furnishes structural support.

The electrochemical removal technique of the invention can be used in fabricating ungated electron emitters. The electron emitters produced according to the invention can be employed to make flat-panel devices other than flat-panel CRT displays. Various modifications and applications may thus be made by those skilled in the art without departing from the true scope and spirit of the invention as defined in the appended claims.

We claim:

1. A method comprising the steps of:

providing an initial structure in which (a) a first electrically non-insulating region comprises first material, (b) impedance means is electrically coupled to a multiplicity of electrically non-insulating members, and (c) each non-insulating member comprises the first material; and electrochemically removing at least part of the first material of the non-insulating region by a procedure that involves applying a selected potential to the non-insulating region, the impedance means providing sufficiently high impedance during the removing step that the first material of each non-insulating member largely electrically decoupled from the non-insulating region outside the impedance means and any intervening electrolytic solution is not significantly electrochemically attacked during the removing step.

2. A method as in claim 1 wherein the first material of any non-insulating member electrically coupled to the non-insulating region outside the impedance means and any intervening electrolytic solution is substantially electrochemically attacked during the removing step.

3. A method as in claim 1 wherein the removing step entails subjecting the initial structure to an electrolytic solution.

4. A method as in claim 1 wherein the initial structure includes an electrically conductive electrode electrically coupled through the impedance means to the non-insulating members.

5. A method as in claim 4 wherein the impedance means physically separates the non-insulating members from the electrode.

6. A method as in claim 4 wherein the removing step is performed without applying a potential, other than the selected potential, to the impedance means or the electrode.

7. A method as in claim 6 wherein the impedance is itself sufficiently high during the removing step, without significant electrolytic assistance from the electrode and any other electrically non-insulating component electrically coupled to the non-insulating members, to largely prevent each so-decoupled non-insulating member from being significantly electrochemically attacked during the removing step.

8. A method as in claim 6 wherein the initial structure includes at least one electrically non-insulating component, including potentially the electrode, electrically coupled to the non-insulating members for electrolytically assisting the impedance means in preventing each so-decoupled non-insulating member from being significantly electrochemically attacked during the removing step.

9. A method as in claim 4 wherein the removing step involves applying a further potential to the electrode.

10. A method as in claim 9 wherein the further potential is sufficiently different from the selected potential to assist the impedance means in preventing each so-decoupled non-insulating member from being significantly electrochemically attacked during the removing step.

11. A method as in claim 1 wherein the impedance (a) is of magnitude less than a transition value $Z_{BT}$ when a voltage $V_Z$ across the impedance means is between a transition value $V_{ZT}$ and an upper operating value and (b) is of magnitude greater than $Z_{BT}$ when voltage $V_Z$ is approximately between $-V_{ZT}$ and zero.

12. A method as in claim 1 wherein the initial structure includes an electrically insulating region situated between the impedance means and the first non-insulating region, a like multiplicity of openings extending through the insulating region, each non-insulating member largely situated in a corresponding one of the openings.

13. A method as in claim 12 wherein the initial structure includes a second non-insulating region situated between the first non-insulating region and the insulating region, a like multiplicity of openings respectively continuous with the openings through the insulating region extending through the second non-insulating region.

14. A method as in claim 13 wherein the resistive layer is of resistance (a) less than a transition resistance value $R_{BT}$ when a voltage $V_Z$ across the resistive layer is between a transition value $V_{ZT}$ and an upper operating value during normal operation of a final structure containing the impedance means and the non-insulating members and (b) greater than $R_{BT}$ when voltage $V_Z$ is between $-V_{ZT}$ and zero during the removing step.

15. A method as in claim 12 wherein the second non-insulating region is not substantially electrochemically attacked during the removing step.

16. A method as in claim 15 wherein the second non-insulating region consists at least partially of second material different from the first material.

17. A method as in claim 1 wherein substantially all the first material of the non-insulating region is removed during the removing step.

18. A method as in claim 1 wherein the impedance means comprises an electrically resistive layer.

19. A method as in claim 1 wherein the impedance means comprises at least one diode configured to be forwardly conductive during normal operation of a final structure containing the impedance means and the non-insulating members.

20. A method as in claim 1 wherein the impedance means is configured to implement at least a capacitor.

21. A method comprising the steps of:

providing an initial structure in which (a) an electrically non-insulating control electrode overlies an electrically insulating layer situated over impedance means, (b) a multiplicity of composite openings extend through the control electrode and the insulating layer, (c) an excess layer comprising first electrically non-insulating emitter material overlies the control electrode, and (d) a like multiplicity of electron-emissive elements are respectively situated in the composite openings, each electron-emissive element comprising the first emitter material and being electrically coupled to the impedance means; and electrochemically removing at least part of the first material of the excess layer by a procedure that involves applying a selected potential to the excess layer, the impedance means being of sufficiently high impedance during the removing step that the first material of each electron-emissive element largely electrically decoupled from the excess layer outside the impedance means and any intervening electrolytic solution is not significantly electrochemically attacked during the removing step.

22. A method as in claim 21 wherein the first material of any electron-emissive element electrically coupled to the control electrode outside the impedance means and any intervening electrolytic solution is substantially electrochemically attacked during the removing step.

23. A method as in claim 21 wherein the removing step entails subjecting the initial structure to a selected electrolytic solution.

24. A method as in claim 23 wherein the removing step is performed with an electrochemical cell containing the selected electrolytic solution, operation of the cell being regulated by a control system having a working-electrode conductor electrically coupled to the control electrode.

25. A method as in claim 23 wherein the selected electrolytic solution contains:

hydroxide of at least one of lithium, sodium, potassium, rubidium, and cesium at a molar concentration of 0.005–0.05; and nitrate of at least one of lithium, sodium, potassium, rubidium, and cesium at a molar concentration of 0.005–3.0.

26. A method as in claim 23 wherein the selected potential is in the range of 0.2–1.0 volt relative to a Normal Hydrogen Electrode.

27. A method as in claim 21 wherein the initial structure includes an electrically conductive emitter electrode that underlies the impedance means, the electron-emissive elements being electrically coupled to the emitter electrode through the impedance means.

28. A method as in claim 27 wherein the excess layer is electrically coupled to the control electrode, the selected potential being applied through the control electrode to the excess layer.

29. A method as in claim 27 wherein the removing step is performed without applying a potential, other than the selected potential, to the impedance means or the emitter electrode.

30. A method as in claim 29 wherein the impedance is itself sufficiently high during the removing step, without significant electrolytic assistance from the emitter electrode and any other electrically non-insulating component electrically coupled to the electron-emissive elements, to largely prevent each so-decoupled electron-emissive element from being significantly electrochemically attacked during the removing step.

31. A method as in claim 29 wherein the initial structure includes at least one electrically non-insulating component, including potentially the emitter electrode, electrically coupled to the electron-emissive elements for electrolytically assisting the impedance means in preventing each so-decoupled electron-emissive element from being significantly electrochemically attacked during the removing step.

32. A method as in claim 27 wherein the removing step involves applying a further potential to the emitter electrode.

33. A method as in claim 32 wherein the further potential is sufficiently different from the selected potential to assist the impedance means in preventing each so-decoupled electron-emissive element from being significantly electrochemically attacked during the removing step.

34. A method as in claim 21 wherein the impedance (a) is of magnitude less than a transition value $Z_{BT}$ when a voltage $V_Z$ across the impedance means is between a transition value $V_{ZT}$ and an upper operating value during normal operation of a final electron-emitting structure containing the control electrode, the insulating layer, the impedance means, and the electron-emissive elements, and (b) is of magnitude greater than $Z_{BT}$ when voltage $V_Z$ is approximately between $-V_{ZT}$ and zero during the removing step.

35. A method as in claim 21 wherein the control electrode is not substantially electrochemically attacked during the removing step.

36. A method as in claim 21 wherein the control electrode consists partially of second material different from the first material.

37. A method as in claim 36 wherein the first material consists primarily of tungsten and the second material consists primarily of chromium and/or nickel.

38. A method as in claim 21 wherein substantially all of the first material of the excess layer is removed during the removing step.

39. A method as in claim 21 wherein the electron-emissive elements are provided generally in the shape of cones.

40. A method as in claim 21 wherein the first material of the excess layer accumulates over the control electrode during deposition of the first material into the composite openings to form at least portions of the electron-emissive elements.

* * * * *

UNITED STATES PATENT AND TRADEMARK OFFICE
CERTIFICATE OF CORRECTION

PATENT NO. : 5,893,967
ISSUE DATE : April 13, 1999
INVENTOR(S) : N. Johan Knall et al It is certified that error appears in the above-identified patent and that said Letters Patent is hereby corrected as shown below:

Cover page, item 63, "Pat. No. 5,766,466" should read "Pat. No. 5,766,446".

Col. 1, line 12, "Pat. No. 5,766,466" should read "Pat. No. 5,766,446".

Signed and Sealed this

Twenty-second Day of May, 2001

*Attest:*

Nicholas P. Godici

NICHOLAS P. GODICI

*Attesting Officer*

*Acting Director of the United States Patent and Trademark Office*